US007369113B2

(12) United States Patent
Washio et al.

(10) Patent No.: US 7,369,113 B2
(45) Date of Patent: May 6, 2008

(54) DRIVING DEVICE OF DISPLAY DEVICE, DISPLAY DEVICE AND DRIVING METHOD OF DISPLAY DEVICE

(75) Inventors: Hajime Washio, Sakurai (JP); Shinya Takahashi, Funabashi (JP); Yuhiehiroh Murakami, Matsusaka (JP); Seijirou Gyouten, Matsusaka (JP); Shigeto Yoshida, Nabari (JP)

(73) Assignee: Sharp Kabushiki Kaisha, Osaka (JP)

( * ) Notice: Subject to any disclaimer, the term of this patent is extended or adjusted under 35 U.S.C. 154(b) by 594 days.

(21) Appl. No.: 11/080,848

(22) Filed: Mar. 16, 2005

(65) Prior Publication Data

US 2005/0206604 A1 Sep. 22, 2005

(30) Foreign Application Priority Data

Mar. 17, 2004 (JP) ..... 2004-077269

(51) Int. Cl.
*G09G 3/36* (2006.01)

(52) U.S. Cl. ..... 345/100; 345/204

(58) Field of Classification Search ..... 345/87, 345/88, 89, 90, 91–100, 204
See application file for complete search history.

(56) References Cited

U.S. PATENT DOCUMENTS 6,046,735 A * 4/2000 Bassetti et al. ..... 345/204
6,724,361 B1 4/2004 Washio et al.
7,199,778 B2 * 4/2007 Chi et al. ..... 345/98
2003/0122773 A1 7/2003 Washio et al.
2004/0108989 A1 * 6/2004 Gyouten et al. ..... 345/100
2006/0033694 A1 * 2/2006 Maki ..... 345/89

FOREIGN PATENT DOCUMENTS

EP 1 056 069 A2 11/2000
JP 2002-014318 A 1/2002

* cited by examiner

*Primary Examiner*—Nitin I. Patel
(74) *Attorney, Agent, or Firm*—Harness, Dickey & Pierce, P.L.C.

(57) ABSTRACT

A driving device of a display device includes: a data signal line driving circuit including a shift register which has (i) multiple stages of flip-flops each of which operates in synchronism with a source clock signal and (ii) a level shifter for boosting the source clock signal whose amplitude is smaller than a driving voltage of each of the flip-flops so as to apply the driving voltage to the flip-flop, said data signal line driving circuit causing a sampling circuit to sample the image display data signal based on an output from the shift register so as to output the image display data signal to the data signal line; and control means for causing a frequency of the source clock signal in case of displaying an image to be higher than a frequency of the source clock signal in case of normal display in which multi-gradation display is performed in a full-color mode. Thus, it is possible to provide a driving device of a display device, a display device, and a driving method of the display device, whereby it is possible to reduce power consumption caused by an invalid current of the level shifter.

17 Claims, 18 Drawing Sheets

DRIVING DEVICE OF DISPLAY DEVICE, DISPLAY DEVICE AND DRIVING METHOD OF DISPLAY DEVICE

This Nonprovisional application claims priority under 35 U.S.C. § 119(a) on Patent Application No. 2004/077269 filed in Japan on Mar. 17, 2004, the entire contents of which are hereby incorporated by reference.

FIELD OF THE INVENTION

The present invention relates to a driving device of a play device such as a liquid crystal display device and like, a display device and a driving method of the splay device.

BACKGROUND OF THE INVENTION

In a data signal driving circuit and a scanning signal driving circuit of an image display device, a shift register is widely used in order to determine a timing at which each data signal line samples an image signal and in order to generate a scanning signal provided to each scanning signal line.

While, more power is consumed in an electronic circuit in proportion to a frequency, a load-carrying capacity, and a square of a voltage. Thus, in an image-display-device-connected circuit such as a circuit for generating an image signal to the image display device or in the image display device for example, a driving voltage tends to be set to be a lower voltage in order to reduce the power consumption.

For example, in a circuit using a polycrystalline silicon thin film transistor in order to obtain a wider display area like the data signal line driving circuit or the scanning signal line driving circuit, a threshold voltage difference reaches, for example, about 4V between substrates or even in a single substrate, so that reduction of the driving voltage is insufficiently realized. However, like the circuit for generating an image signal, it is often that the driving voltage is set to be, for example, 3.3V or lower in a circuit using a polycrystalline silicon transistor. Thus, in case of applying a clock signal lower than the driving voltage of the shift register, a level shifter for boosting the clock signal is provided on the shift register. An image display device having such a level shifter is disclosed, for example, in Japanese Unexamined Patent Publication No. 2000/339984 (Tokukai 2000-339984)(publication date: Dec. 8, 2000) and Japanese Unexamined Patent Publication No. 2001/307495 (Tokukai 2001-307495)(publication date: Nov. 2, 2001).

An arrangement and operations of the level shifter disclosed in the foregoing publications are described as follows.

As shown in FIG. 16, when a clock signal CK whose amplitude is about 3.3V for example is applied to the shift register 100, a level shifter 110 boosts the clock signal CK up to a driving voltage (for example, 8V) of the level shifter 100. The boosted clock signal CK is applied to each of flip-flops F1 to Fn, and a level shifter section 120 shifts a start signal SP in synchronism with the clock signal CK.

Incidentally, as shown in FIG. 17 for example, the level shifter 110 includes: a level shift section 111 for shifting a level of the clock signal CK; a power supply control section 112 for stopping supplying power to the level shift section 111 during a stop period in which it is not required to supply the clock signal CK; an input control section (switch) 113 for separating the level shift section 111 from a signal line, via which the clock signal CK is transmitted, during the stop period; input signal control sections 114 each of which turns off an input switching element of the level shift section 111 during the stop period; and an output stabilizing section 115 for keeping an output of the level shift section 111 at a predetermined value during the stop period.

The level shift section 111 includes: p-channel MOS transistors P11 and P12, serving as a difference input pair at an input stage, whose sources are connected to each other; a constant current source Ic for supplying, for example, a driving voltage Vcc of 8V to each of the sources of the transistors P11 as a predetermined current; n-channel MOS transistors N13 and N14 which constitute a current mirror circuit so as to serve as an active load of the transistors P11 and P12; and transistors P15 and N16 having a CMOS structure so as to amplify an output of the difference input pair.

The clock signal CK is inputted to a gate of the transistor P11 via the transistor N31, and an inverse clock signal CKB which is an inverse signal of the clock signal is inputted to a gate of the transistor P12 via the transistor N33. Further, gates of the transistors N13 and N14 are connected to each other, and are connected to a drain of the transistors P11 and N13. While, the drain of the transistors P11 and N13 connected to each other is connected to a gate of the transistors P15 and N16. A source of the transistor P15 is connected to the driving voltage Vcc. Note that, sources of the transistors N13 and N14 are grounded via the n-channel MOS transistor N21 which serves as the power supply control section 112.

In the level shifter 120 arranged in the foregoing manner, when a control signal ENA indicates operation (when a level thereof is high), the transistors N21, N31, and N33 are conductive, and the transistors P32, P34, and P41 are made nonconductive. Under such condition, a current of the constant current source Ic flows via the transistors P11 and N13 or transistors P12 and N14. Further, the current flows via the transistor N21. Moreover, a 3.3V-clock signal CK or a 3.3V-inverse clock signal GKB is applied to each of gates of the transistors P11 and P12. As a result, a current whose amount is in proportion to a gate-source voltage of each of the transistors P11 and P12 flows therethrough. While, the transistors N13 and N14 serve as active loads, so that a voltage of a junction of the transistors P12 and N14 corresponds to a voltage level difference of the clock signals or the inverse clock signals. The voltage becomes a gate voltage of each of the CMOS transistors P15 and N16. The transistors P15 and N16 amplify the voltage with the driving voltage Vcc, and thus amplified voltage is then outputted as an output voltage of 8V.

The level shifter 120 is arranged so as to cause the clock signal CK to switch on/off the transistors P11 and P12 at the input stage, that is, the level shifter 120 is not a voltage driving type but a current driving type in which any one of the transistors P11 and P12 at the input stage is always conductive during the operation, a current of the constant current source Ic is made to shunt according to a ratio of the gate-source voltages of the transistors P11 and P12. On this account, even when an amplitude of the clock signal CK is lower than a threshold value of each of the transistors P11 and P12 at the input stage, it is possible to shift a level of the clock signal CK without any problem.

As a result, each level shifter 120 can output an output voltage OUT obtained by boosting a peak value of a voltage, having the same shape as the clock signal CK whose peak value is lower (by about 3.3V for example) than that of the driving voltage Vcc, up to the driving voltage Vcc (about 8V for example) while a level of a control signal ENA corresponding to each level shifter 120 is high.

While, a liquid crystal display device used in a mobile device has been required to less consume power as the mobile device has been required to operate for an extended period of time. Here, for example, a mobile device such as a mobile phone is not always in a busy state but is in a waiting state for most of the time. Further, an image and a format displayed in a busy state are usually different from those displayed in a waiting state.

For example, in a waiting state, a liquid crystal display device only needs to be able to display a menu screen, time, and the like and therefore may occasionally have low fineness and a small number of display colors. Rather, it is important for a liquid crystal display device to less consume power so as to operate for an extended period of time. Conversely, in a busy state, a liquid crystal display device usually displays a large quantity of sentences, figures, images such as pictures and therefore is required to perform high-definition display. At this time, other parts (e.g., a communication module, an input interface section, and an operation processing section) of a mobile device consume a large amount of electric power, so that a display module less consumes power. Therefore, a mobile device is more strongly required to less consume power in a waiting state than in a busy state.

Accordingly, for example, in an attempt to reduce power consumption in a waiting state, Japanese Laid-Open Publication 248468/2003 (Tokukai 2003-248468; published on Sep. 5, 2003) discloses an image display device 200. In the image display device 200, as shown in FIG. 18, a display screen 201 is divided for display, i.e., partial display. In the partial display mode, the display screen is divided into three areas P1, P2, and P3. For example, the areas P1 and P3 serve as nondisplay portions each of which displays nothing but a white background, and the area P2 displays a static image such as time and wallpaper.

Therefore, in a waiting state, the area P2 serves as a display portion, and the areas P1 and P3 serve as nondisplay portions. Further, in a waiting state, the area P2 and the areas P1 and P3 are driven for display at different refresh rates (rewrite rates). The areas P1 and P3 are driven for display at a lower refresh rate for intermittent writing than the area P2.

This causes the image display device 200 in a busy state to perform high-definition display of a large quantity of sentences, figures, and images such as pictures in a multi-gradation manner and causes the areas P1 and P3 in a waiting state to perform display by more intermittent writing than the area P2 in a waiting state, thereby reducing power consumption.

A driving method of the image display device 200 will be described more in detail based on a timing chart. Note that, a timing chart in case where partial display is not performed will be described first.

First, as shown in FIG. 19, in a full-screen display mode in which partial display is not performed, a gate start pulse GSP becomes high in voltage for every predetermined number of gate clock signals GCK. That is, the gate start pulse GSP becomes high in voltage in every single vertical scanning period (1V). At this time, in a data signal line driving circuit, a source start pulse SSP becomes high in voltage for every predetermined number of source clock signals SCK, so that a data signal DAT is applied to a pixel after preliminary charging with a pre-charge control signal PCTL. Therefore, in this driving method, the gate clock signals GCK and the source clock signals SCK continually operate, and a refresh rate of a display screen 201 is constant. Further, display is performed in every single vertical scanning period. This undesirably incurs an increase in power consumption.

Conversely, as shown in FIG. 20, in a driving mode in which partial display is performed, the areas P1 and P3 serve as nondisplay portions each of which displays nothing but a white background (white data). Moreover, a refresh rate of the white data can be lowered without raising any display problem. This causes the refresh rate to be lower than that of image data for display in the area P2.

Further, the area P2 performs display once in every three vertical scanning periods (3V). That is, the gate clock signals GCK and the gate start pulse GSP, as well as the source clock signals SCK and the source start pulse SSP, are activated in a first vertical scanning period, and the gate clock signals GCK and the gate start pulse GSP, as well as the source clock signals SCK and the source start pulse SSP, are stopped in a second scanning period and a third scanning period so as to stop circuit operation. A liquid crystal is prone to retain display even when thus driven, so that a static image keeps being displayed.

Furthermore, the white data for nondisplay is displayed in every six scanning periods, and a drive circuit thereof is stopped in a fourth scanning period, thereby further reducing power consumption.

Thus, in the image display device 200 of the laid-open publication discloses various techniques for reducing power consumption.

However, the conventional driving device of a display device, the conventional display device, and the conventional driving method of the driving device raise such a problem that: the level shifter 120 is a current driving type in which any one of the transistors P11 and P12 at the input stage is always conductive regardless of whether the clock signal CK or the inverse clock signal CKB is on or off, so that a current of the constant current source Ic flows. Thus, such arrangement is insufficient in terms of power consumption reduction.

Note that, a technique similar to the present invention is disclosed in Japanese Laid-Open Publication 14318/2002 (Tokukai 2002-14318; published on Jan. 18, 2002), and the publication discloses a technique in which a driving frequency in the partial-screen display mode is set to be higher than a driving frequency in the full-screen display mode when performing the partial display. However, the object of the foregoing technique is to prevent uneven display in the conventional technique arranged so that connection is made with a high voltage power source circuit in the full-screen display mode and connection is made with a lower voltage power source circuit in the partial-screen display mode, thereby reducing the power consumption in the partial display. Thus, the foregoing technique is different from the present invention in terms of a cause of the problem to be solved.

SUMMARY OF THE INVENTION

An object of the present invention is to provide a driving device of a display device, a display device, and a driving method of the driving device, whereby it is possible to reduce power consumption caused by an invalid current of a level shifter.

In order to achieve the foregoing object, a driving device according to the present invention for driving a display device is a driving device for driving a display device provided with a display screen, having a plurality of scanning signal lines and a plurality of data signal lines crossing each other, in which an image display data signal is outputted to a pixel provided at each of crossings through each of the data signal lines in synchronism with a scanning signal outputted from each of the scanning signal lines, said driving device includes: a data signal line driving circuit including a shift register which has (i) multiple stages of flip-flops each of which operates in synchronism with a source clock signal and (ii) a level shifter for boosting the source clock signal whose amplitude is smaller than a driving voltage of each of the flip-flops so as to apply the driving voltage to the flip-flop, said data signal line driving circuit causing a sampling circuit to sample the image display data signal based on an output from the shift register so as to output the image display data signal to the data signal line; and a control section for causing a frequency of the source clock signal in case of displaying an image to be higher than a frequency of the source clock signal in case of normal display in which multi-gradation display is performed in a full-color mode.

Further, in order to achieve the foregoing object, a driving device of the present invention for driving a display device and a method of the present invention for driving a display device are arranged so that: a frequency of the source clock signal in case of displaying an image is made higher than a frequency of the source clock signal in case of normal display in which multi-gradation display is performed in a full-color mode.

According to the present invention, the driving device of the display device includes a data signal line driving circuit including a shift register which has (i) multiple stages of flip-flops each of which operates in synchronism with a source clock signal and (ii) a level shifter for boosting the source clock signal whose amplitude is smaller than a driving voltage of each of the flip-flops so as to apply the driving voltage to the flip-flop, said data signal line driving circuit causing a sampling circuit to sample the image display data signal based on an output from the shift register so as to output the image display data signal to the data signal line.

Thus, in case of driving the driving device of the display device, an invalid current of the transistor of the level shifter constantly flows, so that power is consumed.

Thus, in the present invention, when displaying an image, the control section causes the frequency of the source clock signal to be higher than that in case of the normal display in which multi-gradation display is performed in a full-color mode. As a result, a time in which an invalid current flows becomes short, so that it is possible to reduce the power consumption.

Therefore, it is possible to provide the driving device of the display device and the driving method of the display device whereby it is possible to reduce power consumption caused by an invalid current of the level shifter.

For a fuller understanding of the nature and advantages of the invention, reference should be made to the ensuing detailed description taken in conjunction with the accompanying drawings.

BRIEF DESCRIPTION OF THE DRAWINGS

FIG. 1(*b*), showing an embodiment of the liquid crystal device of the present invention, is a waveform diagram showing a display portion in a partial display mode of the data signal line driving circuit.

FIG. 5(*b*) is a timing chart showing operation of the reset flip-flop.

DESCRIPTION OF THE EMBODIMENTS

One embodiment of the present invention will be described below with reference to FIGS. 1 to 15.

Figure 2:
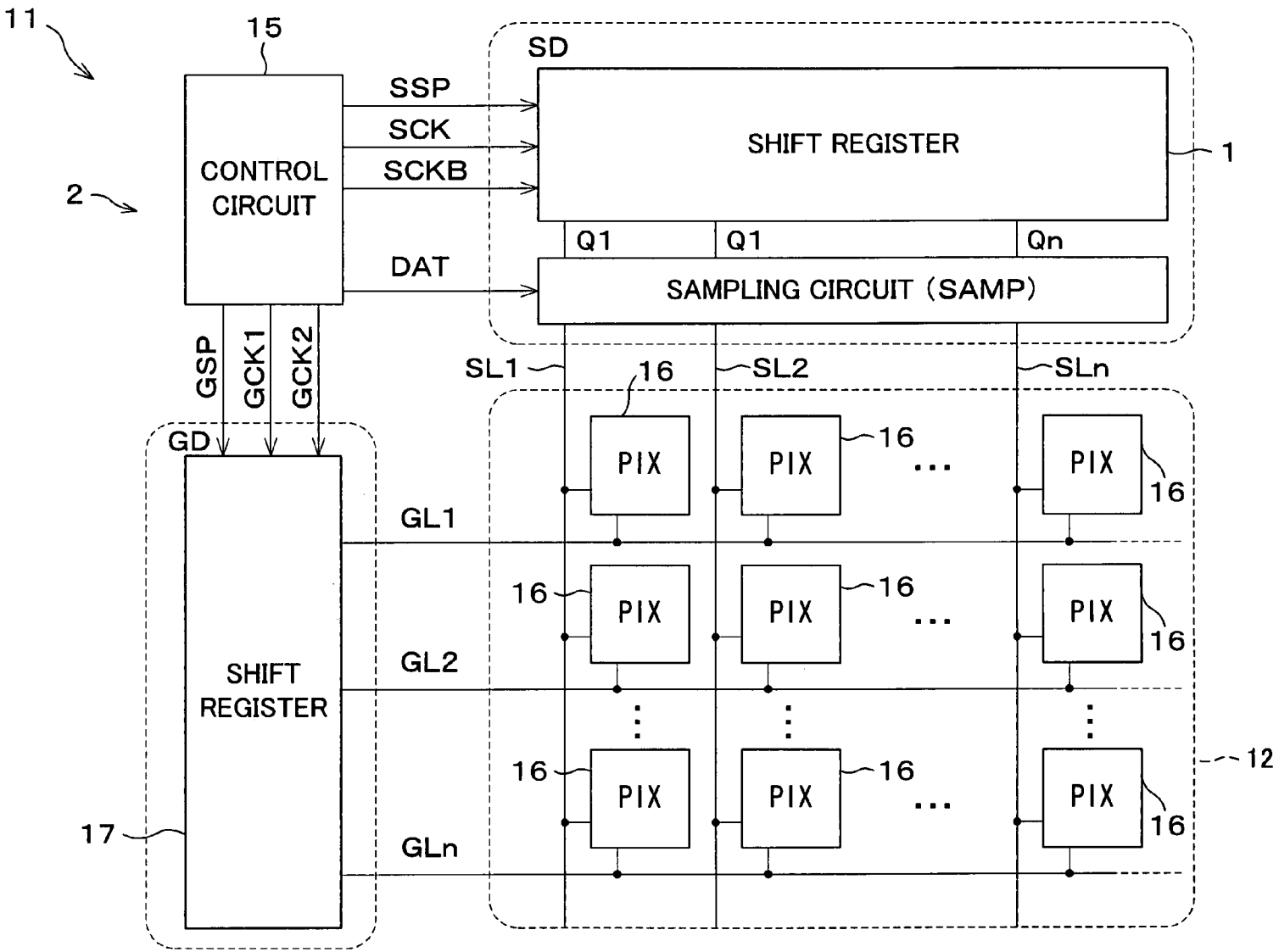
FIG. 2 is a block diagram showing an arrangement of the liquid crystal display device.

As shown in FIG. 2, a liquid crystal display device 11, serving as a display device of the present embodiment, has a display screen 12, a scanning signal line driving circuit GD, a data signal line driving circuit SD, and a control circuit 15 serving as control means. The scanning signal line driving circuit GD, the data signal line driving circuit SD, and the control circuit 15 constitute a driving device 2.

The display screen 12 has n number of scanning signal lines . . . GL (GL1, GL2, . . . GLn) parallel to one another, n number of data signal lines . . . SL (SL1, SL2, . . . SLn)

parallel to one another, and pixels (PIX in the figure) 16 arranged in a matrix manner. Each of the pixels 16 is formed in an area surrounded by two scanning signal lines GL adjacent to each other and two data signal lines SL adjacent to each other. Note that, the number of scanning signal lines GL and the number of data signal lines SL are equally n for the purpose of convenience in description, but the numbers may be different from each other.

The scanning signal line driving circuit GD has a shift register 17. The shift register 17 is arranged so as to serially generate scanning signals which are supplied to scanning signal lines GL1, GL2, . . . connected to the pixels 16 in respective lines based on two types of gate clock signals GCK1 and GCK2 and a gate start pulse GSP inputted from the control circuit 15. Note that, a circuit arrangement of the shift register 17 will be described later.

The data signal line driving circuit SD has a shift register 1 and a sampling circuit SAMP. Two types of source clock signals SCK and SCKB whose phases are different from each other and a source start pulse SSP are inputted from the control circuit 15 into the shift register 1, and a multi-gradation data signal DAT, i.e., an image display data signal serving as a video signal is inputted from the control circuit 15 into the sampling circuit SAMP. The inverse source clock signal SCKB is an inverse signal of the source clock signal SCK.

The data signal line driving circuit SD is arranged so as to cause the sampling circuit SAMP to sample the multi-gradation data signal DAT based on output signals Q1 to Qn outputted from respective stages of the shift register 1, thereby outputting thus obtained video data to data signal lines SL1, SL2, . . . connected to the pixels 16 in respective rows.

The control circuit 15 is a circuit which generates various control signals for controlling operation of the scanning signal line driving circuit GD and the data signal line driving circuit SD. As described above, clock signals GCK1, GCK2, SCK, and SCKB, start pulses GSP and SSP, a multi-gradation data signal DAT, and the like are prepared to serve as control signals.

Note that, the scanning signal line driving circuit GD of the liquid crystal display device 11, the data signal line driving circuit SD, and the pixels 16 of the display screen 12 are respectively provided with switch elements.

Figure 3:
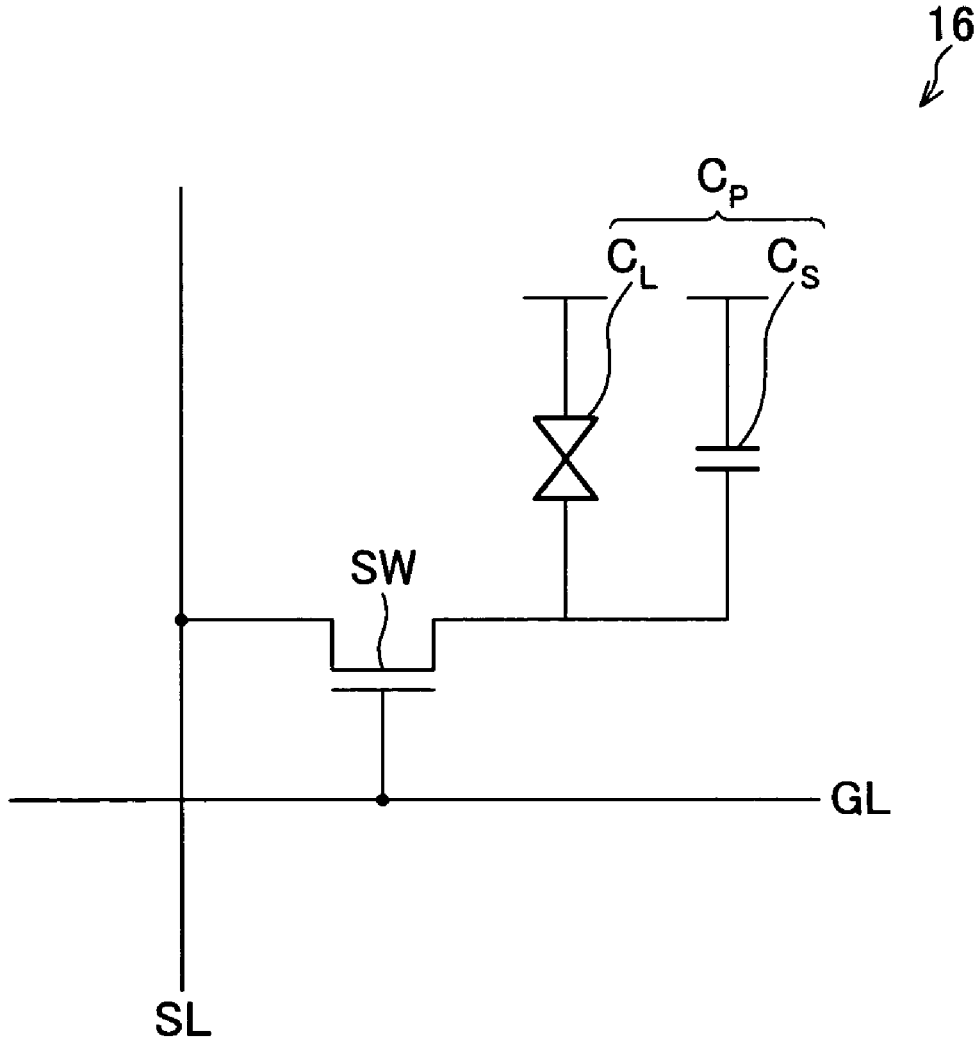
FIG. 3 is a block diagram of the data signal line driving circuit of the liquid crystal display device.

When the liquid crystal display device 11 is an active-matrix liquid crystal display device, the pixel 16, as shown in FIG. 3, is constituted of a pixel transistor SW serving as a switch element made of a filed-effect transistor and a pixel capacitor CP (to which an auxiliary capacitor is added if necessary) including a liquid crystal capacitor CL. In such a pixel 16, a data signal line SL is connected to an electrode on one side of the pixel capacitor CP through a drain and a source of the pixel transistor SW, and a gate of the pixel transistor SW is connected to a scanning signal line GL, and one electrode on the other side of the pixel capacitor CP is connected to a common electrode line (not shown) which is shared by all pixels.

Here, a pixel 16 connected to an i-th data signal line SLi and a j-th scanning signal line GLj is represented by PIX (i, j) (i is such an integer as $1 \leqq i$ and j is such an integer as $j \geqq n$). Then, in the PIX (i, j), when the scanning signal line GLj is selected, the pixel transistor SW becomes conductive, and a voltage serving as video data applied to the data signal line SLi is applied to the pixel capacitor CP. When the voltage is thus applied to the liquid capacitor CL in the pixel capacitor CP, a transmittance or a reflectance of a liquid crystal is modulated. Therefore, when the scanning signal line GLj is selected and a signal voltage according to video data is applied to the data signal line SLi, a display mode of the PIX (i, j) can be changed in accordance with the video data.

In the liquid crystal display device 11, the scanning signal line driving circuit GD selects a scanning line signal GL, and video data to a pixel 16 corresponding to a combination of the scanning signal line GL being selected and a data signal line SL is outputted to each data signal line SL by the data signal line driving circuit SD. This allows the video data to be written in the pixel 16 connected to the scanning signal line GL. Moreover, the scanning signal line driving circuit GD sequentially selects scanning signal lines GL, and the data signal line driving circuit SD outputs the video data to data signal lines SL. As a result, the video data is written in all the pixels 16 of the display screen 12, so that an image in accordance with a multi-gradation data signal DAT is displayed on the display screen 12.

Here, in an interval from the control circuit 15 to the data signal line driving circuit SD, video data to each pixel 16 is transmitted as a multi-gradation data signal DAT in a time-sharing manner, and the data signal line driving circuit SD extracts video data from the multi-gradation data signal DAT at a timing based on: a source clock signal SCK, serving as a timing signal, whose duty ratio is 50% or less at a predetermined cycle (in the present embodiment, a low period is shorter than a high period); an inverse source clock signal SCKB, whose phase is different by 180° from that of the source clock signal SCK; and a source start pulse SSP.

Specifically, the shift register 1 of the data signal line driving circuit SD sequentially outputs in a shifting manner a pulse corresponding to a half clock cycle when a source start pulse SSP is inputted in synchronism with a source clock signal SCK and an inverse source clock signal SCKB, thereby generating output signals Q1 to Qn different from each other by one clock in terms of a timing. Further, the sampling circuit SAMP of the data signal line driving circuit SD extracts video data from a multi-gradation data signal DAT at timings of the respective output signals Q1 to Qn.

Meanwhile, the shift register 17 of the scanning signal line driving circuit GD sequentially outputs in a shifting manner a pulse corresponding to a half clock cycle when a gate start pulse GSP is inputted in synchronism with gate clock signals GCK1 and GCK2, thereby outputting scanning signals, different from each other by one clock in terms of a timing, to the respective scanning signal lines GL1 to GLn.

Figure 17:
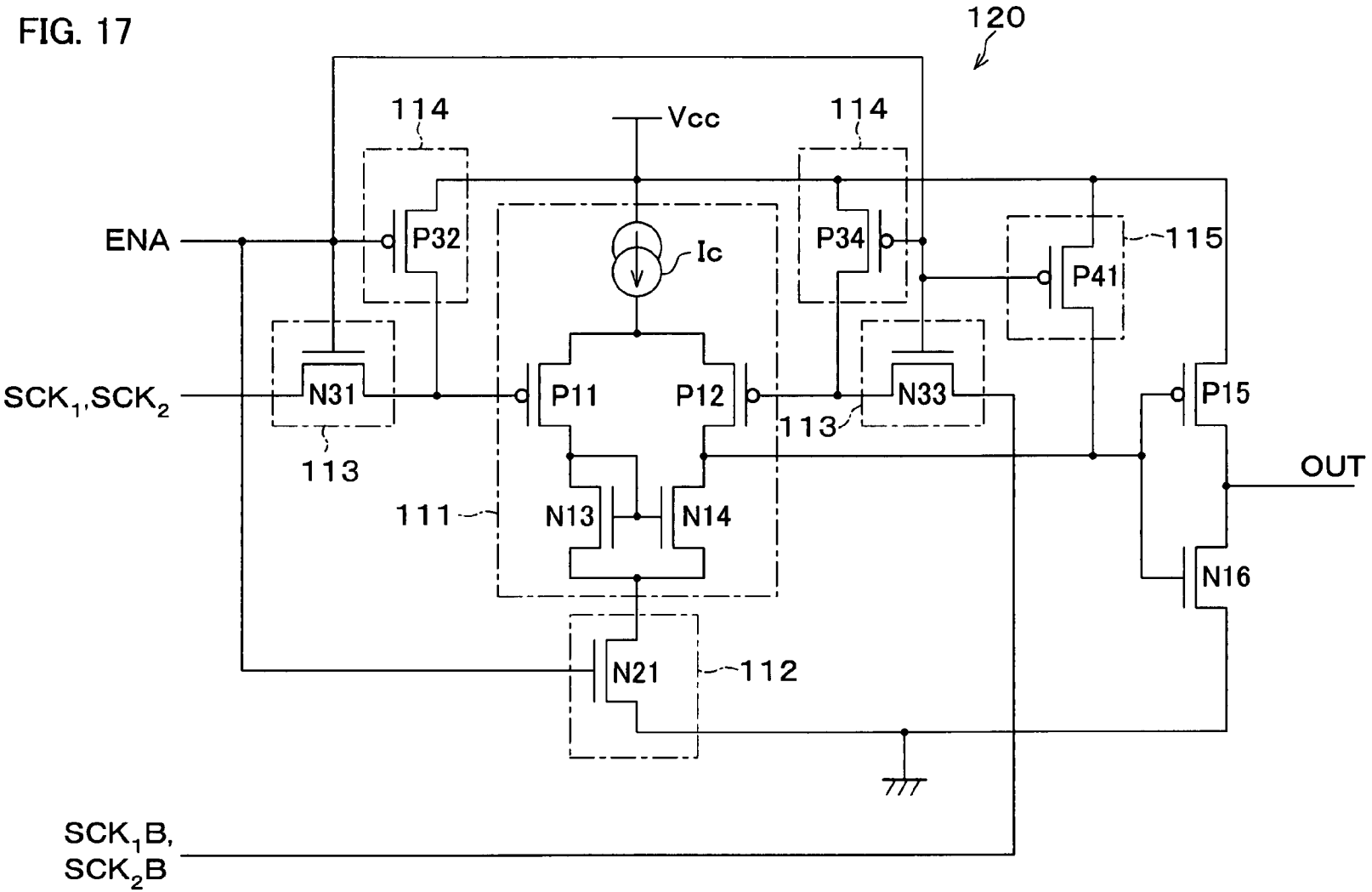
FIG. 17 is a circuit diagram showing an arrangement of a level shifter of a shift register used in the data signal line driving circuit.
Figure 18:
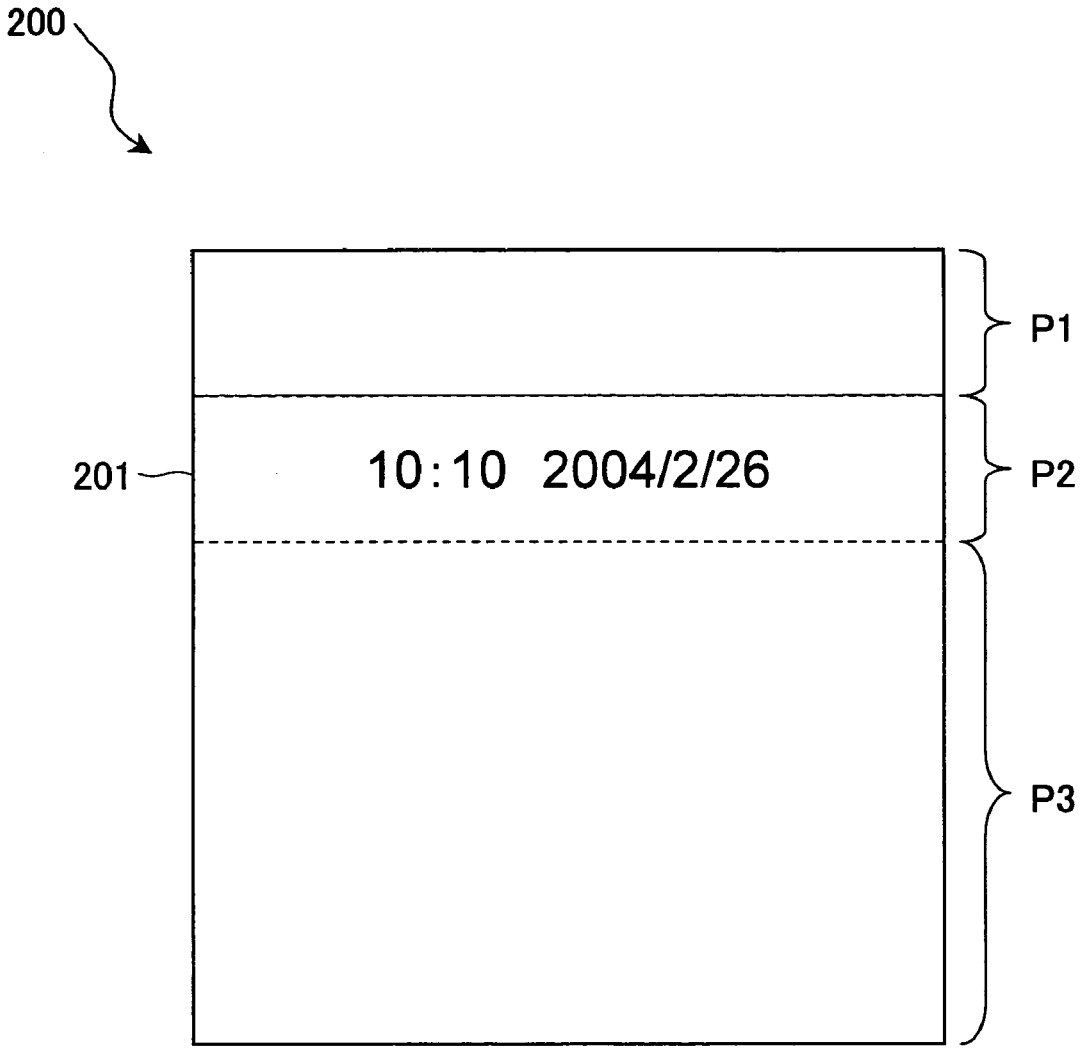
FIG. 18, showing an arrangement of other conventional liquid crystal display device, is a front view showing a condition under which an image is displayed in the partial display mode.
Figure 19:
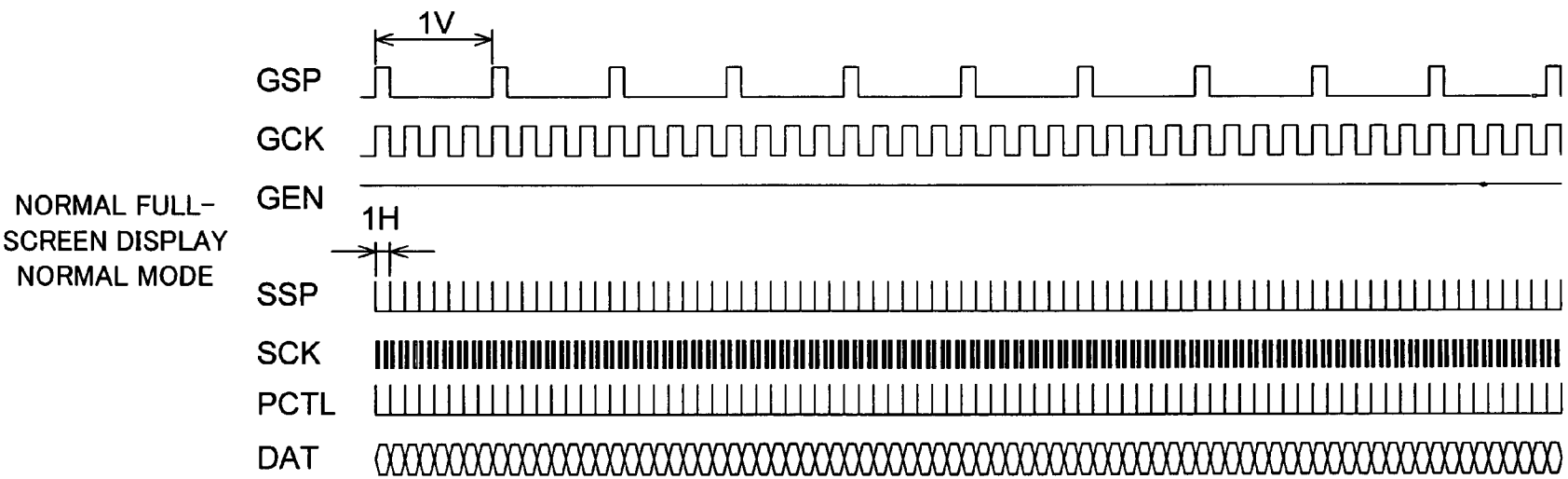
FIG. 19 is a timing chart showing waveforms of input/output signals of the liquid crystal display device in the whole image display mode.
Figure 20:
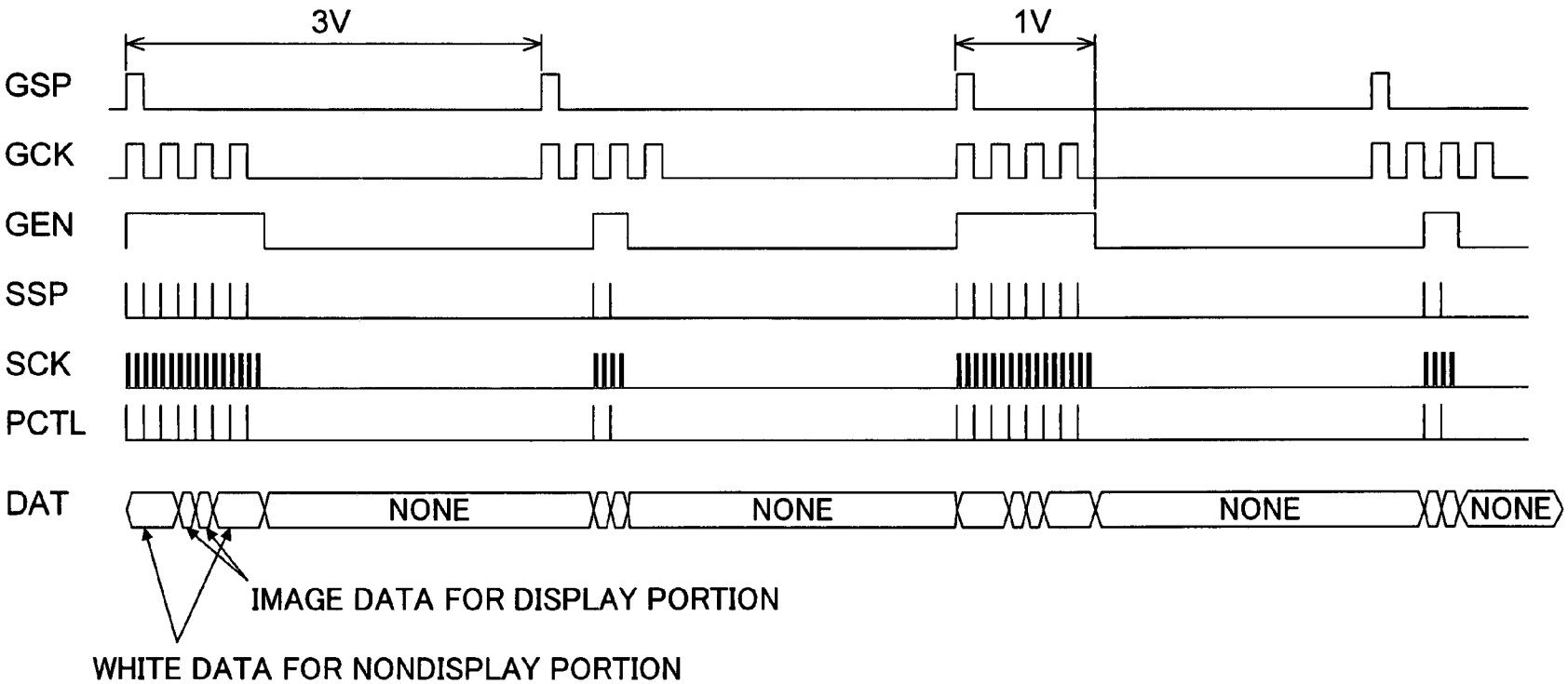
FIG. 20 is a timing chart showing waveforms of input/output signals of the liquid crystal display device in the partial display mode in a waiting state.

Both an outline arrangement of the shift register 1 of the data signal line driving circuit SD and that of the shift register 17 of the scanning signal line driving circuit GD can be the same as a conventional arrangement shown in FIG. 17. However, a reset-set flip-flop used in the shift register 1 or 17 of the present embodiment is arranged differently from the conventional arrangement, so that a concrete example of the reset-set flip-flop will be described in detail below.

Figure 4:
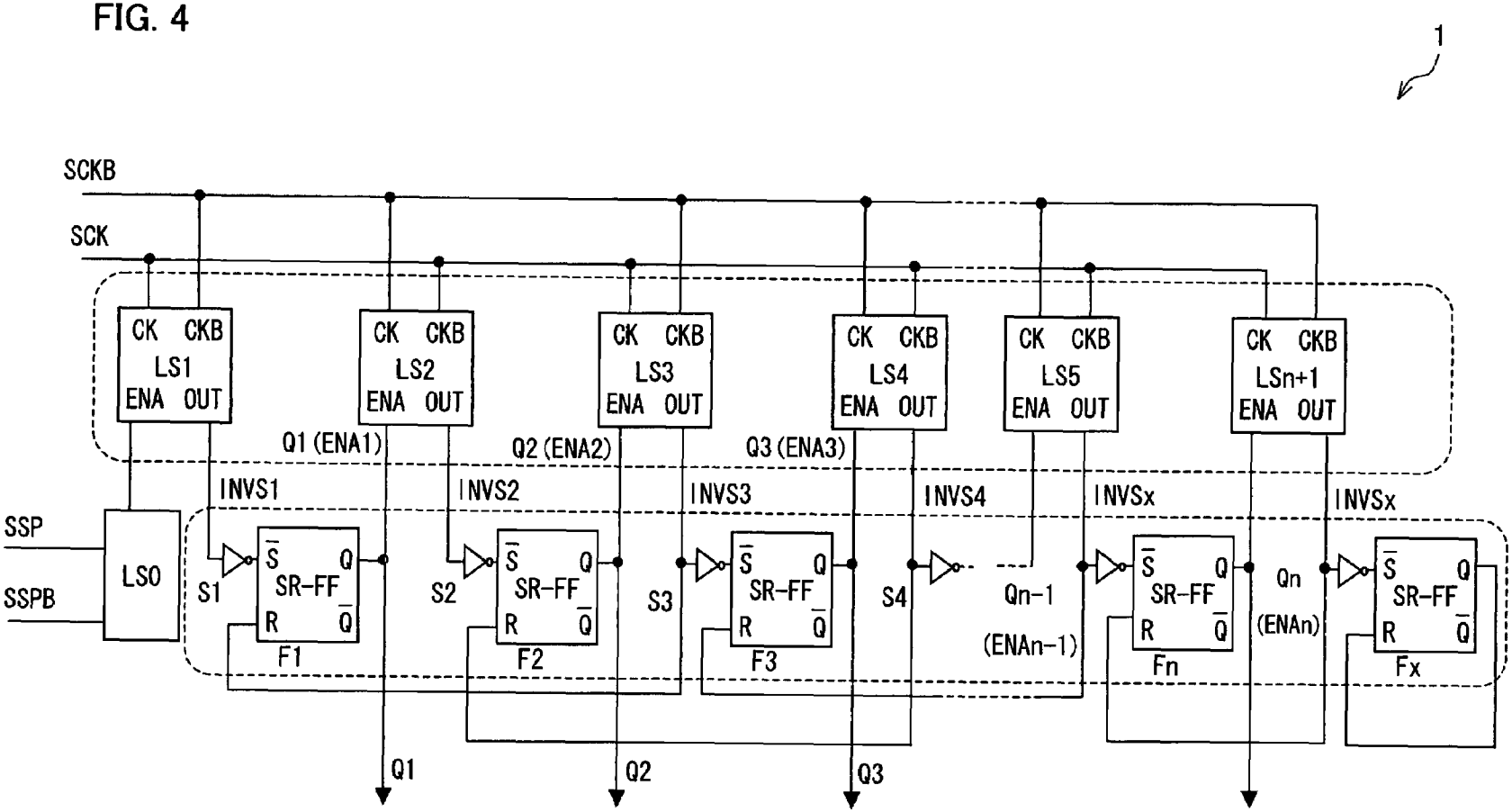
FIG. 4 is a block diagram showing an internal arrangement of a shift register of the data signal line driving circuit of the liquid crystal display device.

As shown in FIG. 4, the shift register 1 of the data signal line driving circuit SD of the present embodiment is constituted of reset-set flip-flops (SR-FF) (hereinafter referred to as "RS flip-flops") connected in a multistage manner. Further, also in the present embodiment, as is conventional, the shift register 1 of the data signal line driving circuit SD has a level shifter LS for shifting a level of a source clock signal SCK and that of an inverse source clock signal SCKB. Therefore, the level shifter LS is arranged so that: a 3.3V source clock signal SCK and an inverse source clock signal SCKB that are inputted therein cause output signals Q1, Q2, and Q3 made of an 8V drive voltage to be outputted through an individual shift register SR as a timing signal for causing video data to be outputted to a data signal line SL. Note that, the level shifter LS includes: clock level shifters LS1 to LSn+1, into which a source clock signal SCK or an inverse source clock signal SCKB is inputted; and a source start signal level shifter LS0, into which a source start signal SSP or an inverse source start signal SSPB is inputted.

One example of an arrangement of an RS flip-flop constituting the shift register 1 will be described with reference to FIGS. 5(*a*) and 5(*b*). Note that, as shown in FIG. 6, an RS flip-flop described below has terminals respectively corresponding to a set signal barred-S, a reset signal R, an output signal Q, and its inverse output signal barred-Q.

Figure 5:
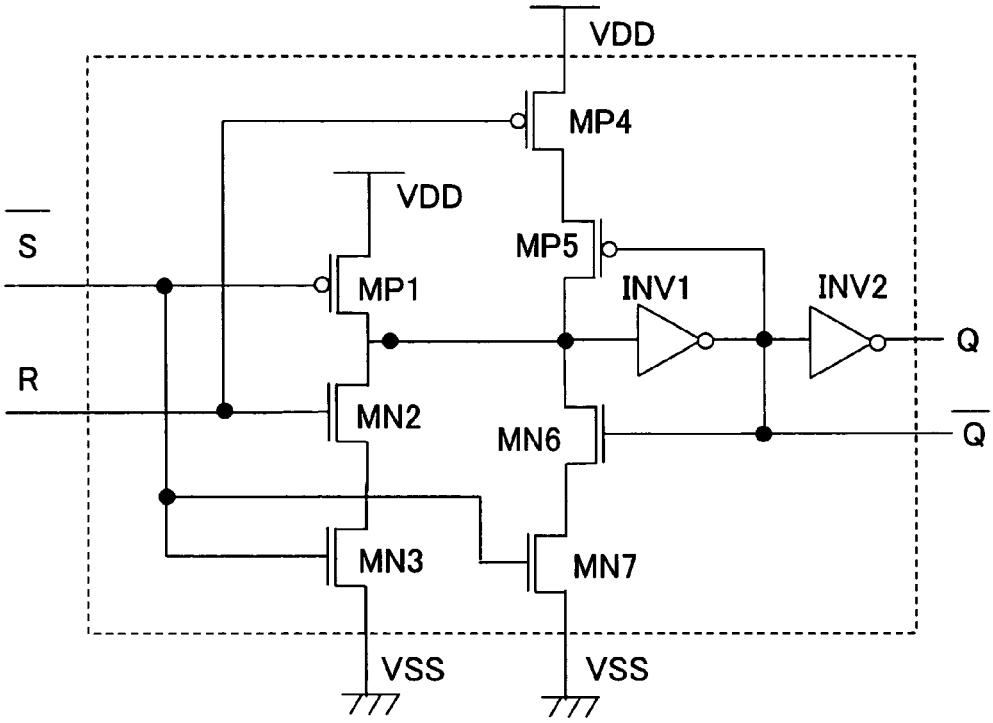
FIG. 5(*a*) is a block diagram showing a basic structure of a reset flip-flop of the shift register of the data signal line driving circuit.
Figure 5:
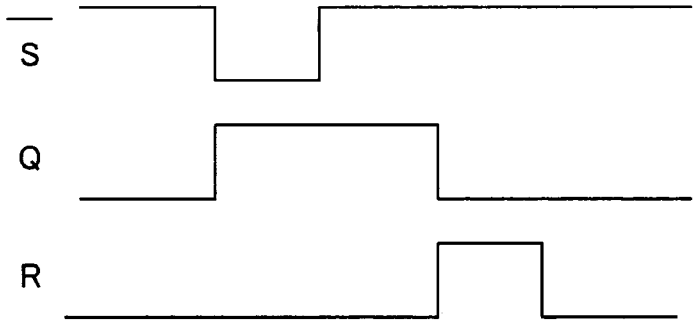
Figure 6:
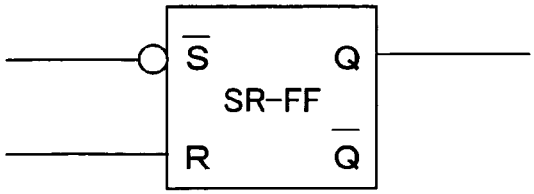
FIG. 6 shows a basic structure of the reset flip-flop of the shift register of the data signal line driving circuit.

In the RS flip-flop, as shown in FIG. 5(*a*), a p-channel transistor MP1 and n-channel transistors MN2 and MN3 are connected in series between power supplies VDD and VSS, and p-channel transistors MP4 and MP5 and n-channel transistors MN6 and MN7 are connected in series between power supplies VDD and VSS.

Into a gate of the p-channel transistor MP1, a gate of the n-channel transistor MN3, and a gate of the n-channel transistor MN7, the set signal barred-S is inputted. Into a gate of the p-channel transistor MP4 and a gate of the n-channel transistor MN2, the reset signal R is inputted. Further, a junction of the p-channel transistor MP1 and the n-channel transistor MN2 is connected to a junction of the p-channel transistor MP5 and the n-channel transistor MN6 and to an inverter circuit INV1.

Further, an output of the inverter circuit INV1, connected to a gate of the n-channel transistor MN6 and a gate of the p-channel transistor MP5 and to an inverter circuit INV2, becomes an output Q serving as an output of the RS flip-flop.

Operation of the RS flip-flop of the foregoing arrangement will be described below.

As shown in FIGS. 5(*a*) and 5(*b*), when the set signal barred-S is inputted to reach a low level, the p-channel transistor MP1 is turned on and the n-channel transistor MN3 is turned off. Further, at this time, a level of the reset signal R is low, and the n-channel transistor MN2 is turned off, and the p-channel transistor MP4 is turned on. In this state, since the junction of the p-channel transistor MP1 and the n-channel transistor MN2 is a power supply VDD (high), an input signal into the inverter circuit INV1 is a power supply VDD (high), so that an output of the inverter circuit INV1 is low in voltage.

At the same time, the set signal barred-S is inputted into the n-channel transistor MN7, so that the n-channel transistor MN7 is turned off. Further, the output of the inverter circuit INV1 is low in voltage, so that the n-channel transistor MN6 is also turned off, and the p-channel transistor MP5 is turned on. At this time, the output signal Q of the RS flip-flop is outputted as a signal whose level is high.

Then, when a voltage of the set signal barred-S becomes high, the p-channel transistor MP1 is turned off, and the n-channel transistors MN3 and MN7 are turned on. Meanwhile, the reset signal R is still low in voltage, so that the n-channel transistor MN2 is turned off, and the p-channel transistor MP4 is turned on. Therefore, the output signal Q remains high in voltage.

Then, when the reset signal R becomes high in voltage, the n-channel transistor MN2 is turned on, and the p-channel transistor MP4 is turned off. This causes the input into the inverter circuit INV1 to become low in voltage, so that the output of the inverter circuit INV1 becomes high in voltage. Further, the output of the inverter circuit INV1 turns on the n-channel transistor MN6 and turns off the p-channel transistor MP5.

Therefore, the output signal Q becomes low in voltage.

Then, when the reset signal R becomes low in voltage, the input of the inverter circuit INV1 remains low in voltage since the n-channel transistors MN6 and MN7 are turned on. The output signal Q is also outputted as a signal whose level is low.

Note that, a combination of the RS flip-flop and the level shifter described in the conventional example can constitute the shift register 1 shown in FIG. 4.

Figure 7:
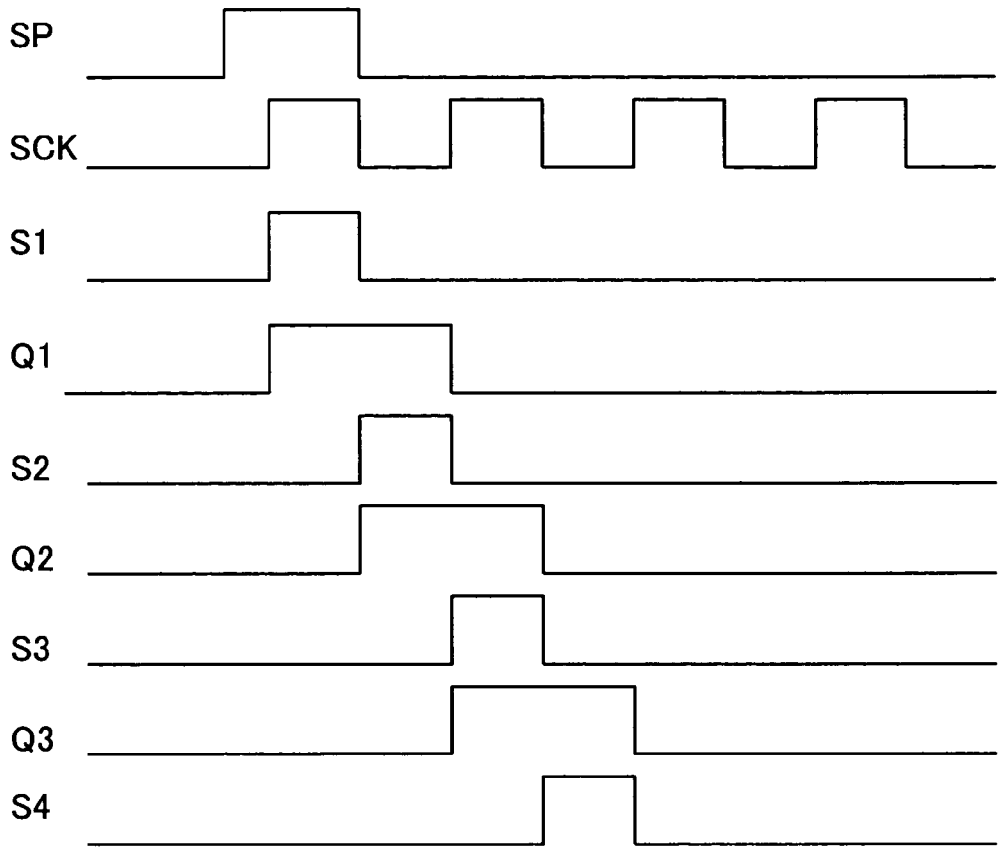
FIG. 7 is a timing chart showing waveforms of input/output signals of the shift register using the reset flip-flop.

Operation of the shift register 1 shown in FIG. 4 will be described with reference to FIG. 4 and a timing chart shown in FIG. 7.

As shown in FIG. 4, when a source start signal SSP is first inputted, the source start signal SSP is boosted by the source start signal level shifter LS0 up to a power supply voltage of the shift register 1 and is inputted into an ENA terminal of the clock level shifter LS1.

The clock level shifters LS1 to LSn+1 of the present embodiment are arranged so as to operate only when an ENA signal is high in voltage. Therefore, while the source start signal SSP is high in voltage, the clock level shifter LS1 operates to take in a source clock signal SCK, so that a signal boosted up to the power supply voltage of the shift register 1 is outputted as an output S1. The output S1 is inverted by the inverter circuit INVS1, and is inputted into an RS flip-flop F1, and is generated as an output signal Q1. The output signal Q1 is inputted into an ENA terminal of the clock level shifter LS2 to activate the clock level shifter LS2 and is outputted as an output S2 from the clock level shifter LS2. As with the output S1, the output S2 is inverted by the inverter circuit INVS2, and is inputted into an RS flip-flop F2, and is generated as an output signal Q2. At this time, since the source start signal SSP is already low in voltage, the clock level shifter LS1 is in a non-operating state. On this account, hereafter, the RS flip-flop F1 will not operate until the next time the source start signal SSP becomes high in voltage. The output signal Q2 of the RS flip-flop F2 is inputted into an ENA terminal of the clock level shifter LS3 to boost the source clock signal SCK, so that the output signal Q2 is outputted as an output S3 from the clock level shifter LS3. Further, the output S3 is inverted by the inverter circuit INVS3, and is inputted into an RS flip-flop F3, and is inputted into a reset terminal of the RS flip-flop F1, so that the output signal Q1 of the RS flip-flop F1 becomes low in voltage.

The shift register 1 operates by repeating the operations described above.

Figure 8:
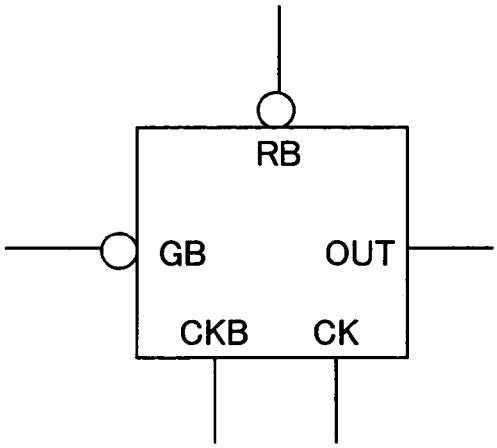
FIG. 8 shows a basic structure of the reset flip-flop of the shift register of the data signal line driving circuit.

Note that, in the present embodiment, not only the foregoing arrangement example of the shift register 1 but also another arrangement of the shift register 1 shown below can be adopted. Further, as shown in FIG. 8, an RS flip-flop will be described below which has terminals respectively corresponding to a control signal GB, a clock signal CK, and its inverse clock signal CKB, a reset signal RB, and an output signal OUT.

Figure 9:
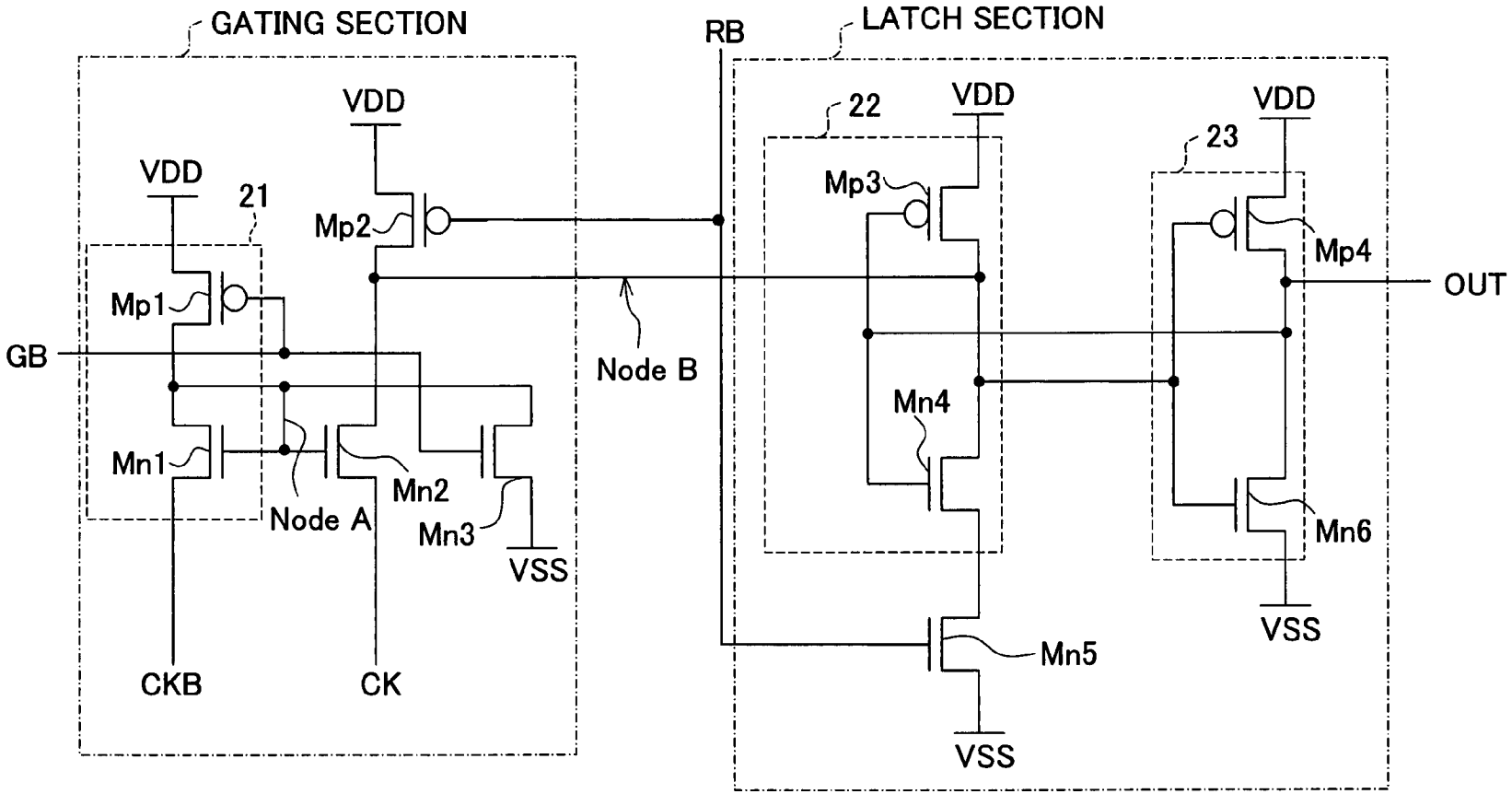
FIG. 9 is a block diagram showing a structure of the reset flip-flop in detail.

As shown in FIG. 9, the RS flip-flop receives a control signal GB, a clock signal CK, and its inverse clock signal CKB, and a reset signal RB. Further, each of the clock signal CK and the inverse clock signal CKB has a voltage of 3.3V and a smaller amplitude, i.e., a smaller voltage than a voltage (8V) of the power supply VDD of the main circuit.

The RS flip-flop is constituted of a gating section and a latch section. The gating section is a function section which supplies a clock signal CK and its inverse clock signal CKB, serving as externally inputted signals, to the latch section at a following stage in accordance with a control signal GB and a reset signal RB inputted separately from the inputted signals. The latch section is a function section which latches the inputted signals supplied from the gating section.

In the gating section, a p-channel transistor Mp1 and an n-channel transistor Mn1 (hereinafter a "p-channel transistor" and a "n-channel transistor" are referred to as a "transistor Mp" and a "transistor Mn" respectively) are connected in series between a power supply VDD (high-voltage) and an input terminal CKB, thereby constituting an inverter circuit 21. Further, transistors Mp2 and Mn2 are connected in series between a power supply VDD and a terminal for a clock signal CK serving as an input signal. Further, a transistor Mn3 is disposed between a drain of the transistor Mp1 and a power supply VSS.

Into a gate of the transistor Mp1 and a gate of the transistor Mn3 respectively, a control signal GB is inputted. Further, drains of the transistors Mp1, Mn1, and Mn3 are respectively connected to gates of the transistors Mn1 and Mn2, and a gate of the transistor Mp2 is connected to a terminal for a reset signal RB.

Further, drains of the transistors Mp2 and Mn2 are respectively connected to drains of transistors Mp3 and Mn4 in the latch section.

Meanwhile, the latch section has: an inverter circuit 22, which is constituted of the transistors Mp3 and Mn4 between a power supply VDD (high-potential) and a power supply VSS (low-potential); and an inverter circuit 23, which is constituted of transistors Mp4 and Mn6 between a power supply VDD (high-potential) and a power supply VSS (low-potential).

The inverter circuit 22 has its input connected to an output of the inverter circuit 23; the inverter circuit 23 has its input connected to an output of the inverter circuit 22. In this way, the inverter circuit 22 and the inverter circuit 23 constitute a latch circuit. That is, the input of the inverter circuit 22 is connected to the output of the inverter circuit 23, and the output of the inverter circuit 22 is connected to the input of the inverter circuit 23. Further, a transistor Mn5 is disposed between the transistor Mn4 of the inverter circuit 22 and the power supply VSS, and an RB terminal of the reset signal RB is connected to a gate of the transistor Mn5.

An output of the inverter circuit 21, i.e., an output from the drains of the transistors Mp1 and Mn1 is a node (Node) A, and an output of the gating section, i.e., an output from the drains of the transistors Mp2 and Mn2 is a node (Node) B. Further, the output of the inverter circuit 23 in the latch section is an output signal OUT.

It is assumed, for example, that: in the RS flip-flop of the foregoing arrangement, each of a clock signal CK and an inverse clock signal CKB has an amplitude of 3.3V, and a power supply VDD of the circuit has a voltage of 8V, and a power supply VSS has a voltage of 0V. Further, it is assumed that n-channel transistors Mn1 to Mn6 have a threshold voltage of 3.5V.

For example, in case where the inverse clock signal CKB receives a low voltage (=0V) and the clock signal CK receives a voltage of 3.3V when the reset signal RB is high in voltage and the terminal for the control signal GB is low in voltage, the transistor Mp1 is in a conductive state and the transistor Mn1 exhibits a diode-like function. Thus, the node (Node) A keeps a potential of around 3.5V, which is proximate to the threshold voltage of the transistor Mn1.

At this time, the clock signal CK is connected to a source of the transistor Mn2 and the node (Node) A is connected to the gate of the transistor Mn2, so that the transistor Mn2 has a gate-source voltage of approximately 0.2V and a threshold voltage of 3.5V. Therefore, the transistor Mn2 is in a non-conductive state.

Meanwhile, when the inverse clock signal becomes 3.3V and the clock signal CK becomes 0V, a potential of approximately 6.8V (=a threshold voltage of 3.5V of the transistor Mn1+a voltage of 3.3V of the inverse clock signal CKB) is generated in the node (Node) A. At this time, because the clock signal CK is 0V, a source-gate voltage of the transistor Mn2 becomes approximately 6.8V. Therefore, the transistor Mn2 has a threshold voltage of 3.5V, so that the transistor Mn2 is in a conductive state, and the node (Node) B becomes 0V.

Therefore, in the gating section, an output of the node (Node) B can be controlled by turning on and off the clock signal CK and the inverse clock signal CKB. In the latch section, the output of the node (Node) B in the gating section can be latched by turning off the reset signal RB in the same driving manner.

Figure 10:
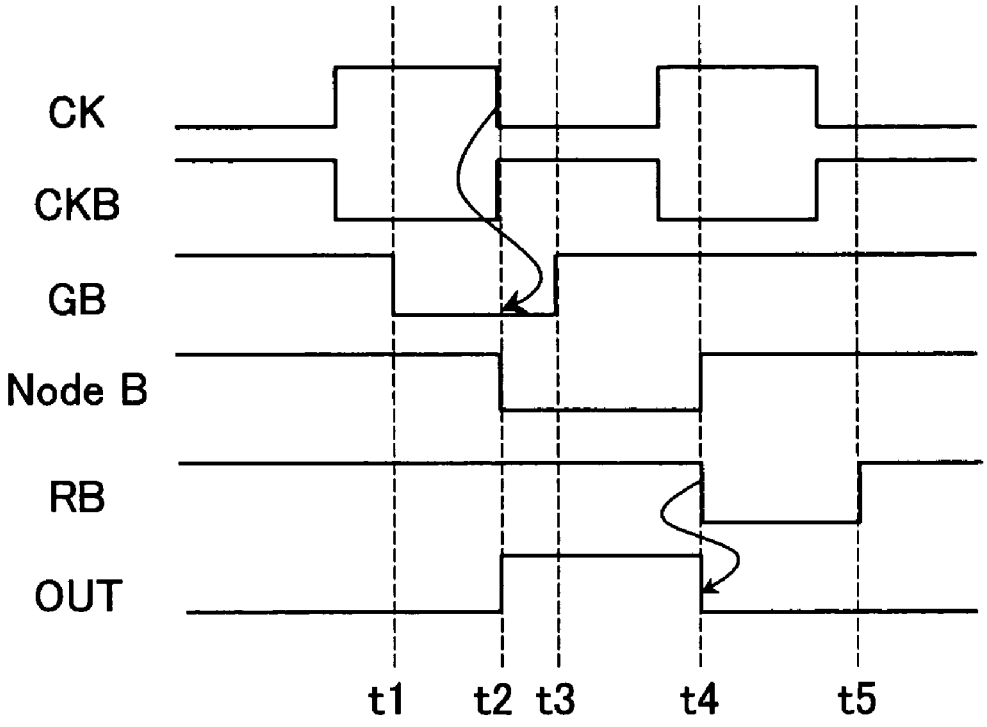
FIG. 10 is a timing chart showing waveforms of input/output signals of the reset flip-flop.

In the following, operation of the RS flip-flop is described with reference to a timing chart shown in FIG. 10.

First, the control signal GB becomes low in voltage in time t1, so that the transistor Mp1 becomes conductive and the transistor Mn3 becomes non-conductive. At this time, as described above, the inverse clock signal CKB has a voltage of 0V, and the clock signal CK has a voltage of 3.3V, and the transistor Mn1 has a threshold voltage of 3.5V, so that a gate electrical potential of the transistor Mn2, i.e., a potential of the node (Node) A becomes a high voltage of approximately 3.5V. Therefore, the transistor Mn2 has a source electrical potential of 3.5V, so that the transistor Mn2 is in a non-conductive state.

At this time, because the reset signal RB has a high voltage (=8V), the transistor Mp2 is in a non-conductive state. Therefore, when the reset signal RB has a high voltage (=8V), the node (Node) B keeps a high voltage without changing its status. That is, in the latch section, when the reset signal RB has a high voltage (=8V), the transistor Mn5 is in a conductive state, and the transistor Mp3 and the transistor Mn4 act as the inverter circuit 22. Further, the inverter circuit 22 constitutes the latch circuit in combination with the inverter circuit 23 constituted of the transistor Mp4 and the transistor Mn6, so that the node (Node) B connected to the latch section does not change its status when the transistor Mp2 is in a non-conductive state.

Next, when a clock pulse is inverted in terms of an on/off state to cause the inverse clock signal CKB to have a voltage of 3.3V and the clock signal CK to have a voltage of 0V in time t2, the node (Node) A has a voltage of approximately 6.8V (=a threshold voltage of 3.5V of the transistor Mn1+ 3.3 V), and the potential of 6.8V is applied to the gate of the transistor Mn2. At this time, the source of the transistor Mn2 has the clock signal CK with a voltage of 0V, so that the transistor Mn2 becomes conductive, thereby causing the node (Node) B to be low in voltage. At this time, the reset signal RB still has a high voltage (=8V), so that the transistor Mp2 is in a non-conductive state, and the transistor Mn5 is in a conductive state, and the transistor Mp3 and the transistor Mn4 function as the inverter circuit 22. Therefore, when the node (Node) B becomes low in voltage, the latch circuit constituted of the inverter circuit 22 and the inverter circuit 23 changes its status, so that the output signal OUT becomes a high voltage (=8V).

Next, in time t3, the control signal GB becomes high in voltage (power supply VDD=8V), so that the transistor Mp1 becomes non-conductive and the transistor Mn3 becomes conductive. Thus, a low voltage (power supply VSS=0V) is applied to the gates of the transistors Mn1 and Mn2, so that the transistors Mn1 and Mn2 are in a non-conductive state and are not affected by the clock signal CK and the inverse clock signal CKB. Accordingly, when the control signal GB has a high voltage (power supply VDD=8V), the gating section will not be affected whatever status the clock signal CK and the inverse clock signal CKB may have. At this time, the node (Node) B is not affected by the clock signal CK due to a non-conductive state of the transistor Mn2, but is kept low in voltage by the latch circuit constituted of the inverter circuit 22 and the inverter circuit 23. As a result, the output signal OUT is kept high in voltage (power supply VDD=8V).

Next, in time t4, the reset signal RB becomes low in voltage (power supply VSS=0V), and the transistor Mp2 is in a conductive state. At the same time, the reset signal RB is supplied also to the gate of the transistor Mn5, so that the transistor Mn5 is in a non-conductive state, and the circuit constituted of the transistor Mp3 and the transistor Mn4 no longer functions as the inverter circuit 22. Accordingly, the node (Node) B becomes high in voltage (power supply VDD=8V) when the transistor Mp2 is in a conductive state, so that the transistor Mn6 of the inverter circuit 23 is in a conductive state, thereby causing the output signal OUT to be a low voltage (power supply VSS=0V).

Finally, in time t5, the reset signal RB becomes high in voltage, and the transistor Mp2 is in a non-conductive state, and the transistor Mn5 is in a conductive state. At this time, the circuit constituted of the transistors Mn4 and Mp3 functions again as the inverter circuit 22, so that the inverter circuit 22 and the inverter circuit 23 function again as the latch circuit. This keeps the node (Node) B in a high state, and as a result keeps the output signal OUT low in voltage.

Figure 11:
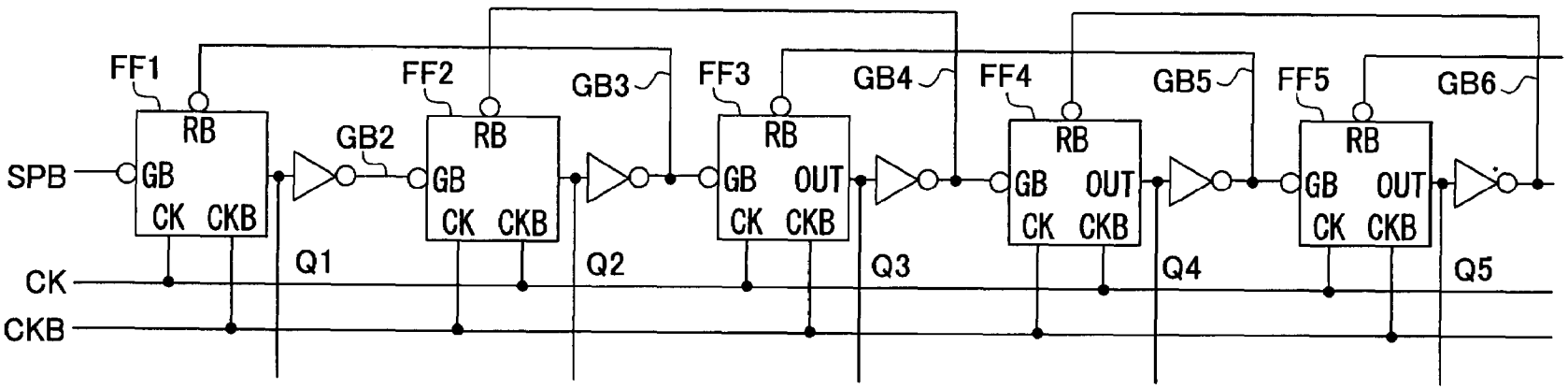
FIG. 11 is a block diagram showing a structure of the shift register using the reset flip-flop.

An example of an arrangement of the shift register 1 using the RS flip-flop of the foregoing arrangement is shown in FIG. 11. Note that, FIG. 11 is an example of an arrangement of the shift register 1 using the RS flip-flop shown in FIG. 9.

The shift register 1 has a plurality of RS flip-flops FF1, FF2, . . . connected in series. The clock signal CK is connected to a CK terminal of an RS flip-flop FFa (a=2n−1, n=1, 2, . . . ), and the inverse clock signal CKB is connected to a CKB terminal thereof.

Meanwhile, the inverse clock signal CKB is connected to a CK terminal of an RS flip-flop FFa (a=2n, n=1, 2, . . . ), and the clock signal CK is connected to a CKB terminal thereof. Thus, the clock signal CK and the inverse clock signal CKB connected to the CK and CKB terminals of the odd-numbered RS flip-flop FFa (a=2n−1, n=1, 2, . . . ) are inversely related to those connected to the CK and CKB terminals of the even-numbered RS flip-flop FFa (a=2n, n=1, 2, . . . ).

Further, in the shift register 1, a start pulse signal SPB is inputted into a GB terminal of the RS flip-flop FF1, and an output signal OUT of the RS flip-flop FFa at each stage is outputted as output signals Q1, Q2, Q3, . . . serving as an output of the shift register 1. Further, the output signals Q1, . . . in the RS flip-flops at respective stages are respectively connected as control signals GB2, . . . thorough respective inverters to a GB terminal of an RS flip-flop FF at a next stage.

Further, in the RS flip-flops FF2, FF3, . . . at a second or further stage, each of inverse signals of the output signals Q2, Q3, . . . is inputted into a GB terminal at a next stage and is also connected to an RB terminal of an RS flip-flop at a previous stage so as to be used as a reset signal. For example, a control signal GB3, which is an inverse signal of the output signal Q2 of the RS flip-flop FF2 at the second stage, is connected to a GB terminal of the RS flip-flop FF3 at a third stage and an RB terminal of the RS flip-flop FF1 at the first stage.

Figure 12:
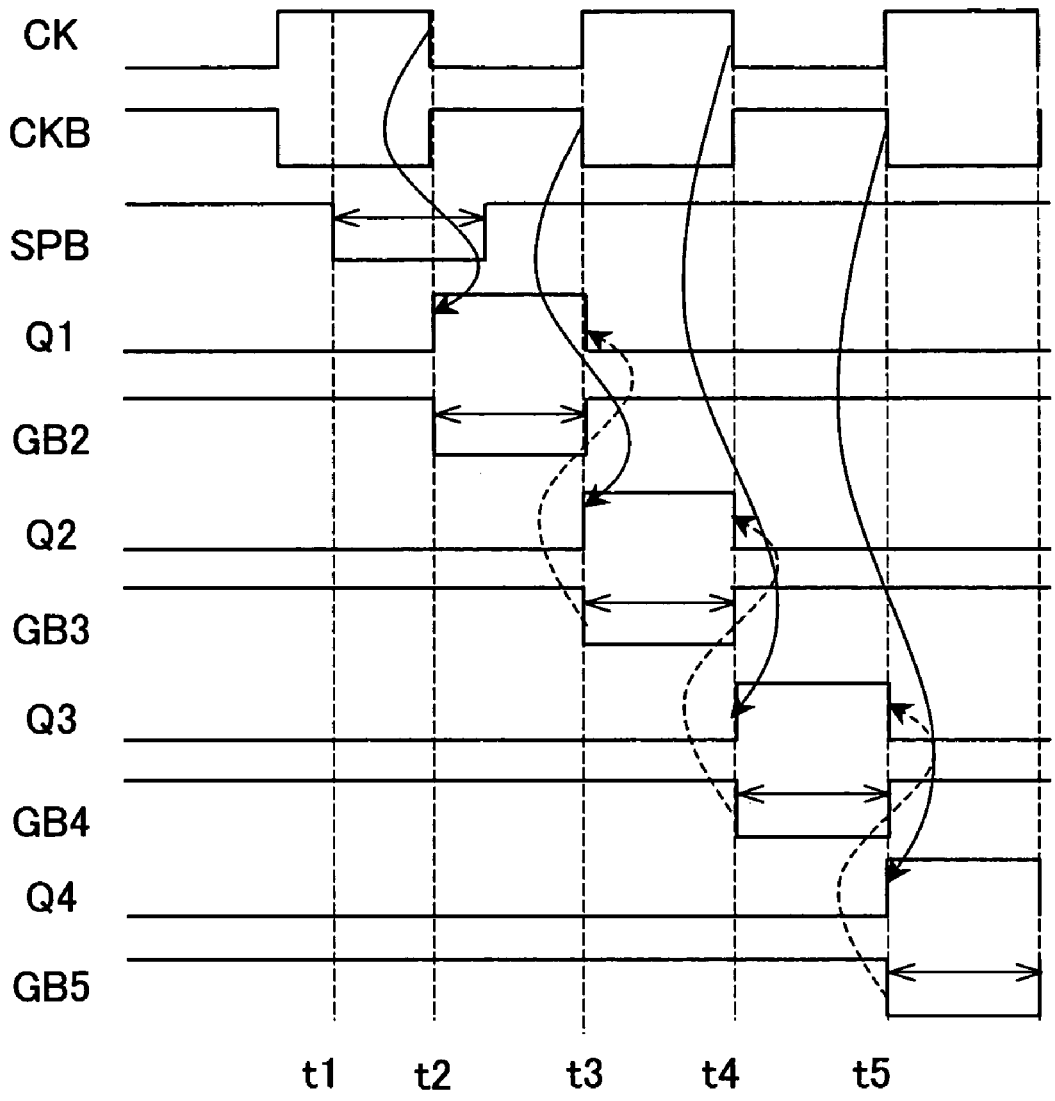
FIG. 12 is a timing chart showing waveforms of input/output signals of the shift register using the reset flip-flop.

In the following, operation of the shift register will be described with reference to a timing chart of FIG. 12.

First, after the start pulse signal SPB is inputted into the GB terminal of the RS flip-flop FF1 in time t1, the clock signal CK becomes low in voltage in time t2, so that an OUT signal of the RS flip-flop FF1, i.e., the output signal Q1 becomes high in voltage. Further, the output signal Q1 is inputted as a control signal GB2 into a GB terminal of the RS flip-flop FF2, so that a low-voltage signal is inputted to the GB terminal of the RS flip-flop FF2.

Then, under such condition that the control signal GB2 with a low voltage inputted into the GB terminal of the RS flip-flop FF2, the inverse clock signal CKB becomes low in voltage in time t3, so that an OUT signal of the RS flip-flop FF2, i.e., the output signal Q2 becomes high in voltage. Further, the control signal GB3, which is the inverse signal of the output Q2, becomes low in voltage. The control signal GB3 is inputted into the GB terminal of the RS flip-flop FF3 and is inputted also into the RB terminal of the RS flip-flop FF1, so that the RS flip-flop FF1 is reset, thereby causing the output Q1 to become low in voltage.

Thus, the reset-set flip-flops connected in series functions as a shift register 1 in synchronism with a clock signal CK and an inverse clock signal CKB. The shift register 1 operates in the same manner even when the clock signal CK and the inverse clock signal CKB have lower amplitude than a power supply VDD of a circuit.

Incidentally, as to the shift register 1, in the level shifter LS of FIG. 4 and in the gating section of FIG. 9, when the control signal GB is low in voltage, each of the level shifter LS and the transistor Mp1 of the gating section is in a current-driven mode, in which each of them is conductive all times and a current of a current generator, i.e., an invalid current is allowed to flow, regardless of whether the clock signal CK/the inverse clock signal CKB is on or off. Therefore, this is insufficient in terms of power consumption reduction.

Figure 13:
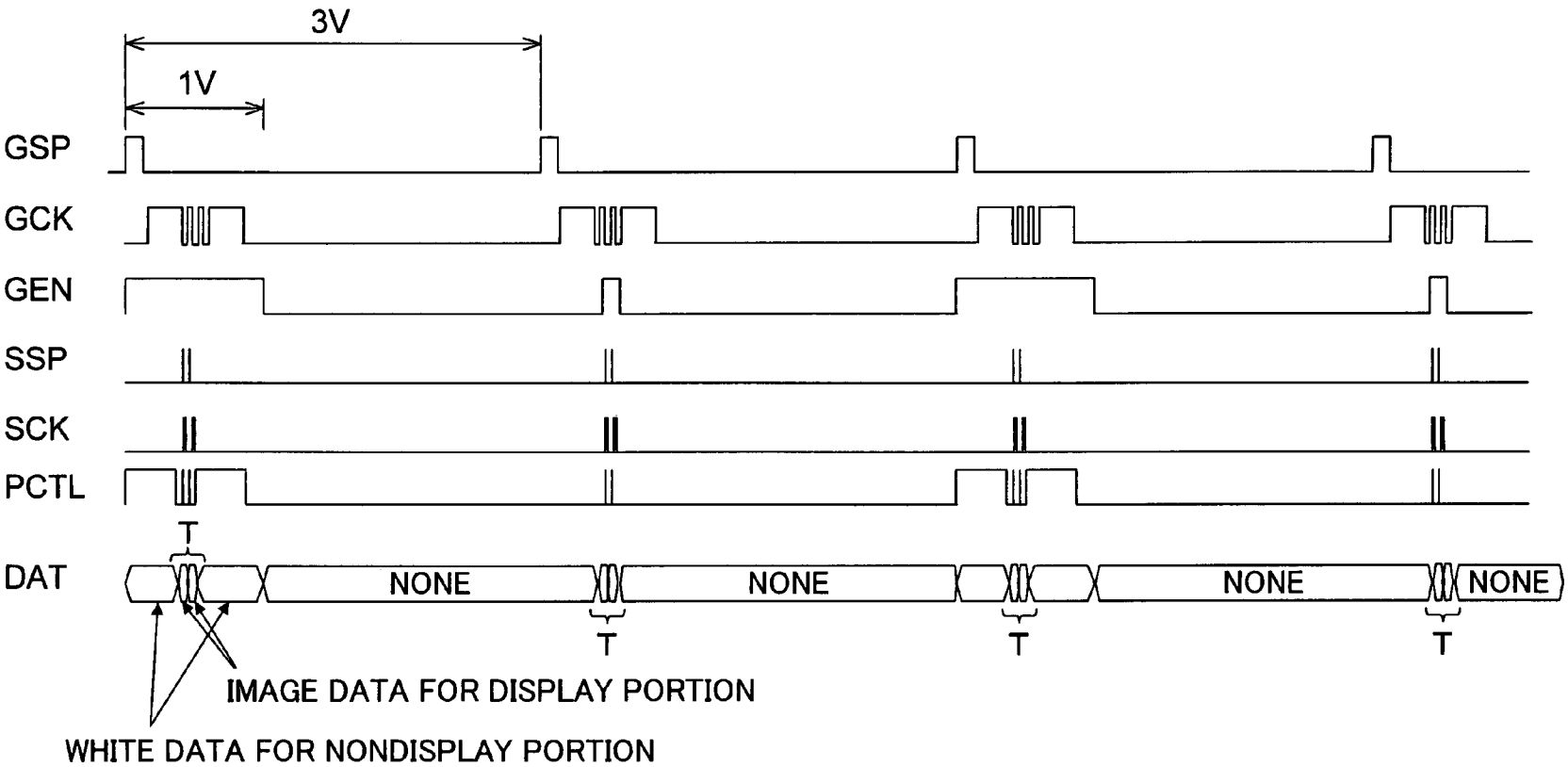
FIG. 13 is a timing chart showing waveforms of input/output signals of the liquid crystal display device in a partial display mode.

Thus, the driving device 2, the liquid crystal display device 11, and the driving method of the liquid crystal display device 11 in the present embodiment are arranged so that: as shown in the timing chart of FIG. 13, a frequency of the source clock signal is raised in a part of time T. That is, in the present embodiment, when displaying an image, the frequency of the source clock signal SCK is controlled so as to be higher than that in case of normal display in which a multi-gradation display is performed in a full-color mode. Note that, in case of the normal display, the display device is generally driven at a frequency of 60 Hz or 50 Hz, but sometimes driven at 30 Hz when any flickering does not occur. Thus, the frequency in the present embodiment is higher than these values.

On this account, a period in which a current of the constant current source, i.e., an invalid current flows is short, which results in reduction of the power consumption. Note that, it is possible to carry out such control not only in the partial display described later but also in the normal display as long as the display device is free from any uneven display. This arrangement results in reduction of power consumption.

Here, before describing the foregoing timing chart, an arrangement in which the liquid crystal display device 11 of the present embodiment performs the partial display is first described as follows.

Figure 14:
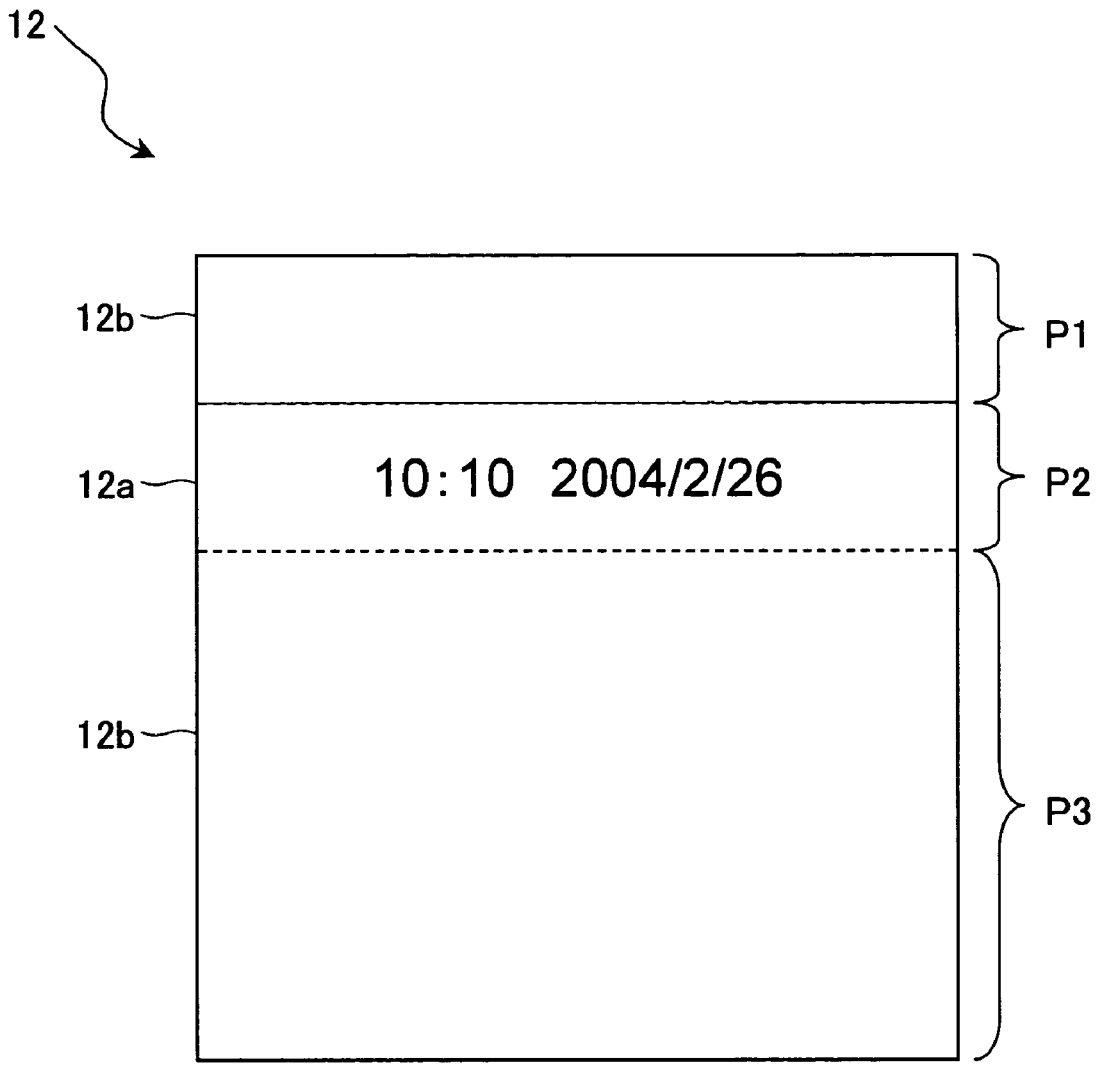
FIG. 14 is a block diagram showing a structure of the data signal line driving circuit of the liquid crystal display device.

That is, the liquid crystal display device 11 of the present embodiment can be used as a display device of a mobile phone. As shown in FIG. 14, the liquid crystal display device 11 is arranged so as to divide the display area of the display screen 12 in displaying an image (i.e., partial display). In the partial display mode, the display area is for example divided into three areas P1, P2, and P3. Further, in a full-screen display mode in which a whole of the display screen 12 performs display, the areas P1, P2, and P3 are used to perform display in a full-color mode. Meanwhile, in a waiting state, a partial-screen display mode is used in which only a part of the display screen 12 performs display. The full-screen display mode and the partial-screen display mode are switched over by a switch (not shown). For example, the areas P1 and P3 serve as nondisplay portions 12*b* each of which displays nothing but a white background, and the area P2 displays a static image such as time and wallpaper.

Here, in the present embodiment, the wallpaper serving as a static image in the area P2 displays an image in accordance with two states, i.e., on/off states of each pixel constituting the area P2. Specifically, three primary colors, red (R), green (G), blue (B), in each pixel are turned on/off, thereby performing eight-color display. On this account, it is possible to reduce the power consumption as compared with the full-color display.

Figure 15:
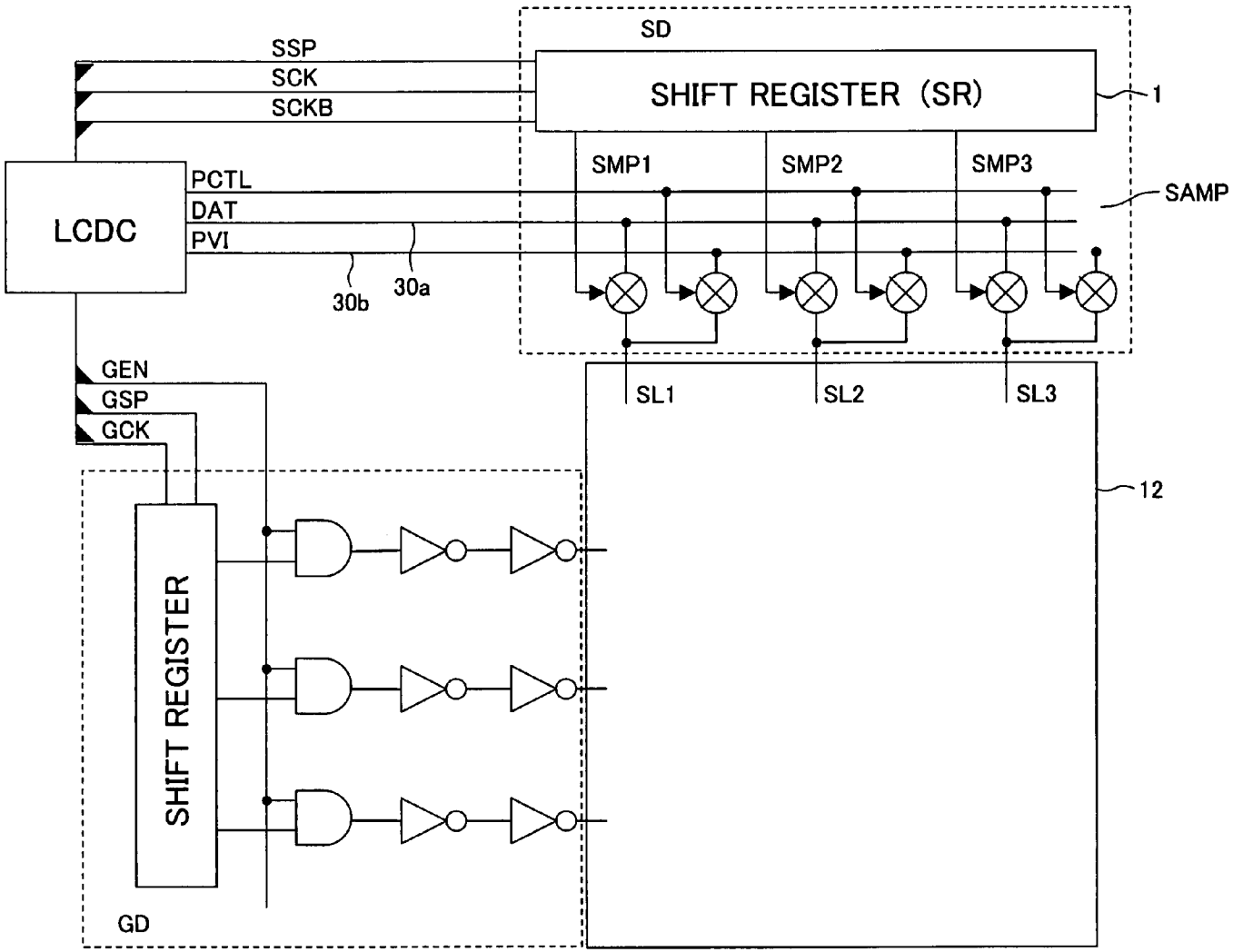
FIG. 15 is a front view showing a condition under which an image is displayed on the liquid crystal display in the partial display mode.
Figure 16:
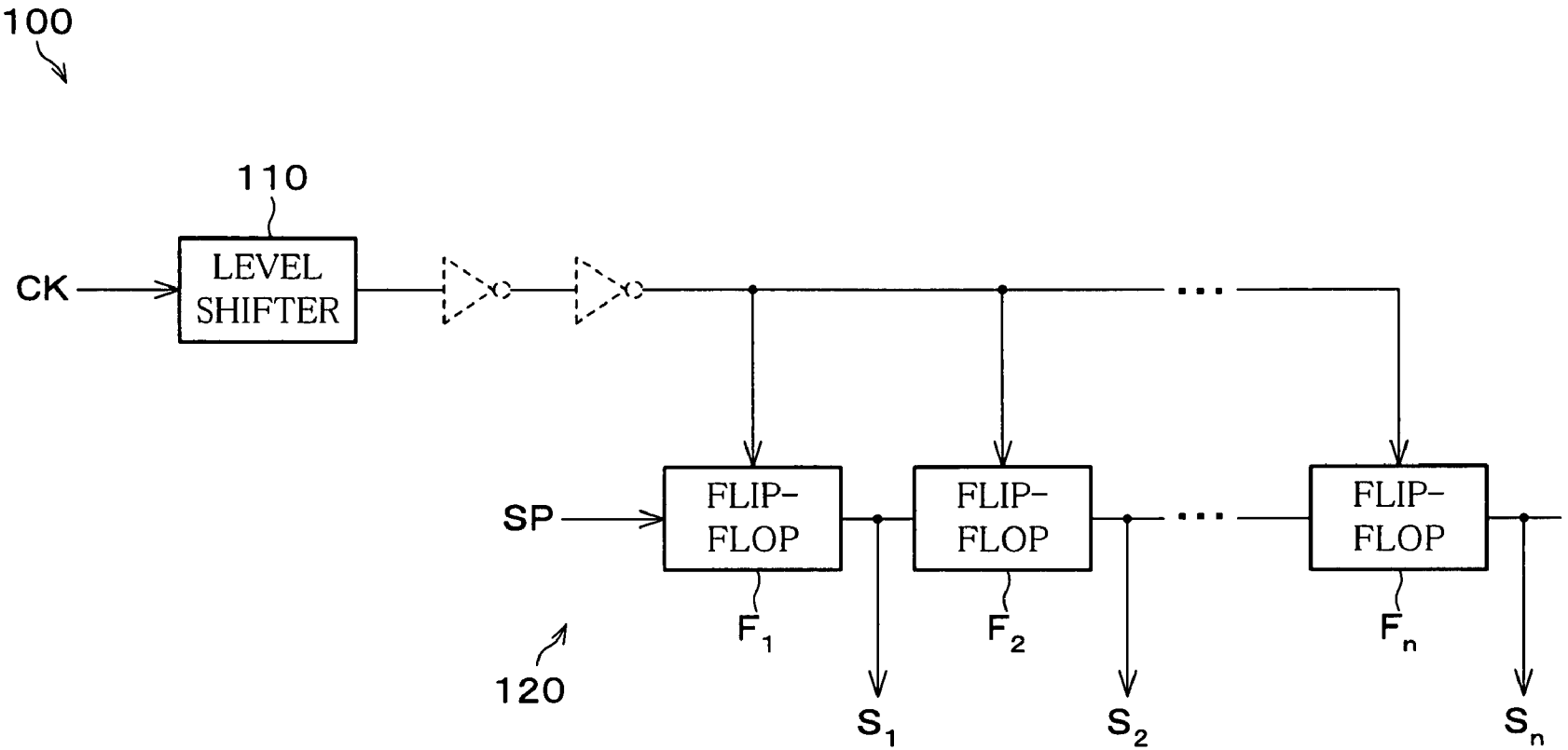
FIG. 16 is a block diagram showing an arrangement of a data signal line driving circuit of a conventional liquid crystal display device.

Specifically, as shown in FIG. 15, the driving device 2, which performs partial display as described above, is arranged so that: (i) a first wiring 30*a* for supplying a multi-gradation data signal DAT to a data signal line driving circuit SD and (ii) a second wiring 30*b* for supplying a constant voltage data writing signal PVI, made of a voltage or a pre-charge voltage to be applied at the time of constant uniform color display, to the data signal line driving circuit SD allow the respective signals to be supplied to a sampling circuit SAMP of the data signal line driving circuit SD. The constant voltage data writing signal PVI is made of a lower voltage than the multi-gradation data signal DAT.

In the present embodiment, the multi-gradation data signal DAT includes not only multi-gradation data of full color but also data indicative of eight-color display obtained by turning on/off three primary colors, red (R), green (G), blue (B), in each pixel as described above. Further, "the voltage of the constant voltage data writing signal PVI that is to be applied at the time of constant uniform color display" means that a binary data signal indicative of two values such as white display and black display is included. Thus, the binary data signal can be used to display an image in the areas P1 and P2.

To the sampling circuit SAMP, a data generating section LCDC additionally supplies a selection signal PCLT for selecting the constant voltage data writing signal PVI. Thus, the multi-gradation data signal DAT is selected by the flip-flop circuit FF of the shift register SR of the data signal line driving circuit SD, and is outputted to the data signal line SL. Further, the constant voltage data writing signal PVI is selected by the selection signal PCLT, and is outputted to the data signal line SL.

On the basis of the timing chart of FIG. 13, a driving method for performing the partial display in the liquid crystal display device 11 arranged in the foregoing manner is described as follows taking into consideration such point that the frequency of the source clock signal SCK is partially raised. That is, FIG. 13 shows a timing chart in a waiting state.

In the present embodiment, as shown in FIG. 13, in a waiting state, display is performed once in every three vertical scanning period (3V). Therefore, a gate clock signal GCK and a gate start pulse GSP, as well as a source clock signal SCK and a source start pulse SSP are activated only in a first vertical scanning period (1V) and are stopped in a second vertical scanning period and a third vertical scanning period, thereby stopping circuit operation.

Even when driven in such a manner, a liquid crystal, having a characteristic of retaining display, keeps displaying a static image. This makes it possible to stop a driving circuit intermittently by skipping display-driving frames intermittently, thereby reducing power consumption.

Further, in the present embodiment, the white data of the background in display of the areas P1 and P3 can be free from any display problem even at a lower refresh rate (rewrite rate), so that an image based on the white data for nondisplay is displayed in every six vertical scanning periods (6V), and the data signal line driving circuit SD is stopped in a third scanning period, a ninth scanning period, . . . in this while, thereby reducing power consumption.

Figure 1:
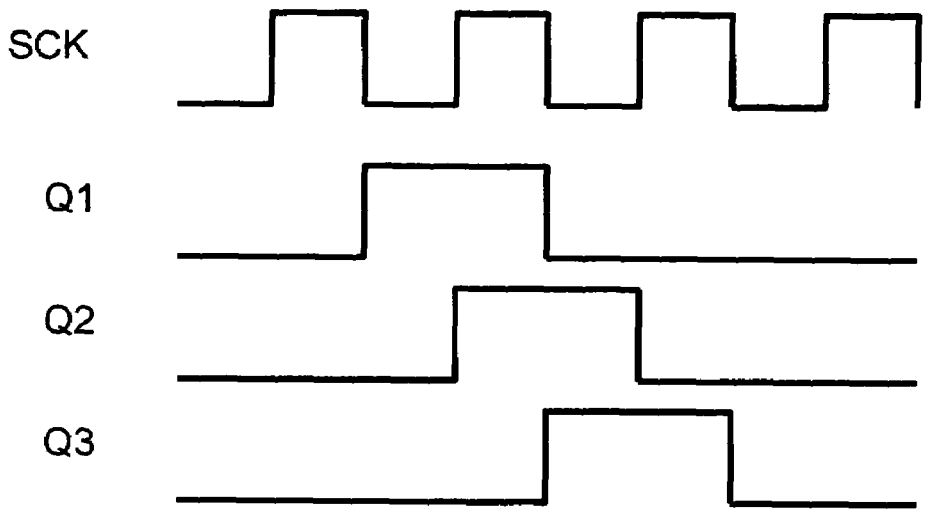
FIG. 1(*a*), showing an embodiment of a liquid crystal display device of the present invention, is a waveform diagram showing a driving waveform in normal display of a data signal line driving circuit.
Figure 1:
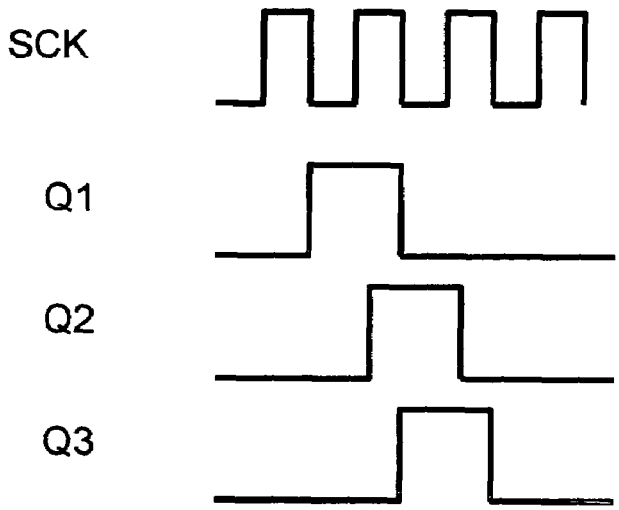

In addition to the power consumption reduction, in the present embodiment, the frequency of the source clock signal SCK is raised in a display time T in which an image based on image data for the display portion is displayed. That is, at the time of normal display in which multi-gradation display is performed in a full-color mode, output signals Q1, Q2, Q3, . . . are outputted with a pulse width of the source clock signal SCK shown in FIG. 1(*a*). While, as shown in FIG. 1(*b*), the frequency of the source clock signal SCK is made higher than the foregoing frequency, thereby reducing the pulse width. Note that, such control is performed by the control circuit 15.

On this account, a time in which a current of the constant current source, i.e., an invalid current flows to the level shifter LS becomes short, so that the power consumption can be reduced.

Further, in the present embodiment, as shown in FIG. 13, as to the gate clock signal GCK, an operation speed of the scanning signal line driving circuit GD is low in scanning the nondisplay portion, and the operation speed of the scanning signal line driving circuit GD is high in scanning the display portion. On this account, also in the scanning signal line driving circuit GD, it is possible to reduce power consumption caused by an invalid current.

Further, in the present embodiment, when displaying an image in the area P2, the selection signal PCLT serving as pre-charge voltage applying means for selecting the constant voltage data writing signal PVI causes a pre-charge voltage to be applied in advance. On this account, it is not necessary to apply a high voltage in performing the eight-color display in the area P2, so that it is possible to reduce the power consumption.

Note that, the selection signal PCLT is not necessarily used to apply a pre-charge voltage in the area P2 serving as a display portion in the partial-screen display mode. That is, the selection signal PCLT serving as voltage applying means allows an arbitrary voltage set with respect to the areas P1 and P3 serving as nondisplay portions in the partial-screen display mode to be applied. Thus, it is possible to display an evenly displayed image or a single-color background image in the areas P1 and P3 serving as nondisplay portions.

As described above, the driving device 2 of the present embodiment for driving the liquid crystal display device 11 and the method of the present embodiment for driving the liquid crystal display device are arranged as follows. The driving device includes: a data signal line driving circuit SD including a shift register 1 which has (i) multiple stages of flip-flops FF each of which operates in synchronism with a source clock signal SCK and (ii) a level shifter LS for boosting the source clock signal SCK whose amplitude is smaller than a driving voltage of each of the flip-flops FF so as to apply the driving voltage to the flip-flop FF, said data signal line driving circuit SD causing a sampling circuit SAMP to sample the image display data signal based on an output from the shift register 1 so as to output the image display data signal to the data signal line SL.

In case of driving the driving device 2 of the liquid crystal display device 11, an invalid current of the transistor of the level shifter LS constantly flows, so that power is consumed.

Thus, in the present embodiment, when displaying an image, the control circuit 15 causes the frequency of the source clock signal SCK to be higher than that in case of the normal display in which multi-gradation display is performed in a full-color mode. As a result, a time in which an invalid current flows becomes short, so that it is possible to reduce the power consumption.

Accordingly, it is possible to provide the driving device 2 of the liquid crystal display device 11 and the driving method of the liquid crystal display device 11 whereby it is possible to reduce power consumption caused by an invalid current of the level shifter LS.

Further, the driving device 2 of the present embodiment for driving the liquid crystal display device 11 and the method of the present embodiment for driving the liquid crystal display device 11 are arranged so that: a full-screen display mode in which a whole of a display screen performs display and a partial-screen display mode in which only a part of the display screen performs display are switched over. Therefore, the partial display mode is adopted in the present invention.

Here, the partial display mode, used for example in a display device of a mobile device such as a mobile phone, is a mode in which an image is partially displayed in a waiting state. Further, since a waiting state occupies a longer period of time, there is particularly a need for reducing power consumption.

Accordingly, in the present embodiment, the control circuit 15 causes a frequency of the source clock signal SCK in case of displaying an image in the display portion in the partial-screen display mode to be higher than a frequency of the source clock signal SCK in case of displaying an image in the display portion in the full-screen display mode.

Thus, power consumed in displaying an image in a long waiting time is reduced, thereby enhancing the effect of power consumption reduction.

Further, the driving device 2 of the present embodiment for driving the liquid crystal display device 11 and the method of the present embodiment for driving the liquid crystal display device 11 are arranged so that: in case of displaying an image in an area P2 serving as a display portion in the partial-screen display mode, the image is displayed by turning on/off the pixel constituting the area P2. Specifically, three primary colors, red (R), green (G), blue (B), in each pixel 16 are turned on/off. That is, generally, there are three primary colors, red (R), green (G), blue (B), in each pixel 16, and red (R), green (G), blue (B) are respectively turned on/off, thereby displaying eight colors different from each other. Thus, an image displayed in a waiting state is a static image, so that this image can be sufficiently recognized even when the image is displayed with eight colors different from each other, and uneven display hardly occurs even when the frequency is raised. As a result, such color display is suitable for displaying an image in the display portion in the partial-screen display mode. Note that, the colors are not necessarily limited to red (R), green (G), blue (B), but it is possible to display an image by turning on/off other colors in each pixel 16 constituting the area P2.

Further, the driving device 2 of the present embodiment for driving the liquid crystal display device 11 and the method of the present embodiment for driving the liquid crystal display device 11 are arranged so that: a frequency of a gate clock signal GCK of the scanning signal of the display portion in the partial-screen display mode is made higher than a frequency of a gate clock signal GCK of the scanning signal in the full-screen display mode, so that an operation speed of the display portion in the partial-screen display mode becomes higher. Thus, a display time in the display portion becomes shorter, so that it is possible to reduce power consumption caused by an invalid current also in the scanning signal line driving circuit GD.

Incidentally, the nondisplay portions in the partial-screen display mode, i.e., the areas P1 and P3 perform display such as white display, black display, or solid image display, and the like. In this case, the liquid crystal display device 11 retains display for a certain time, so that an image is displayed again before the image vanishes.

Thus, the driving device 2 of the present embodiment for driving the liquid crystal display device 11 and the method of the present embodiment for driving the liquid crystal display device 11 are arranged so that: the control circuit 15 causes a frequency of a gate clock signal GCK of the scanning signal of the nondisplay portion in the partial-screen display mode to be lower than a frequency of a gate clock signal GCK of the scanning signal in the full-screen display mode.

On this account, an image is intermittently displayed in the nondisplay portion in the partial-screen display mode, thereby reducing the power consumption.

Further, the driving device 2 of the present embodiment for driving the liquid crystal display device 11 and the method of the present embodiment for driving the liquid crystal display device 11 are arranged so that: the selection signal PCLT causes a constant voltage data writing signal PVI to apply a voltage by using a supply line different from a supply line of the multi-gradation data signal DAT in case of displaying an image in the areas P1 and P3 serving as nondisplay portions in the partial-screen display mode. Thus, in case of displaying an image in the areas P1 and P3 serving as nondisplay portions in the partial-screen display mode, it is possible to apply an arbitrarily set voltage. Thus, it is possible to display a so-called solid image or a single-color image in the areas P1 and P3 in the partial-screen display mode.

Further, in case of displaying an image in the nondisplay portion in the partial-screen display mode, the selection signal PCLT causes a voltage to be applied by using a supply line different from a supply line of the multi-gradation data signal DAT, thereby preventing the current from flowing through the shift register 1 having the level shifter LS. Thus, it is possible to reduce the power consumption caused by an invalid current of the level shifter LS.

Further, the driving device 2 of the present embodiment for driving the liquid crystal display device 11 and the method of the present embodiment for driving the liquid crystal display device 11 are arranged so that: the selection signal PCLT causes a pre-charge voltage to be applied when displaying an image by applying an image display data signal to the display portion in the partial-screen display mode, i.e., the area P2, that is, just before applying the image display data signal.

On this account, the image display data signal is applied after applying the pre-charge voltage to the display portion in the partial-screen display mode, thereby displaying an image. Thus, it is possible to reduce an applied voltage of the image display data signal. As a result, it is possible to further reduce the power consumption.

Further, the liquid crystal display device 11 of the present embodiment includes the aforementioned driving device 2. Thus, it is possible to provide the liquid crystal display device 11 which can reduce the power consumption caused by an invalid current of the level shifter LS.

As described above, the driving device of the present invention for driving the display device and the method of the present invention for driving the display device are arranged so that: a full-screen display mode in which a whole of a display screen performs display and a partial-screen display mode in which only a part of the display screen performs display are switched over so as to drive the display device, and the control means causes a frequency of the source clock signal in case of displaying an image in the display portion in the partial-screen display mode to be higher than a frequency of the source clock signal in case of displaying an image in a display portion in the full-screen display mode.

According to the foregoing invention, a full-screen display mode in which a whole of a display screen performs display and a partial-screen display mode in which only a part of the display screen performs display are switched over. Therefore, the partial display mode is adopted in the present invention.

Here, the partial display mode, used for example in a display device of a mobile device such as a mobile phone, is a mode in which an image is partially displayed in a waiting state. Further, since a waiting state occupies a longer period of time, there is particularly a need for reducing power consumption.

Accordingly, in the present invention, a frequency of the source clock signal in case of displaying an image in the display portion in the partial-screen display mode is made higher than a frequency of the source clock signal in case of displaying an image in a display portion in the full-screen display mode.

Thus, power consumed in displaying an image in a long waiting time is reduced, thereby enhancing the effect of power consumption reduction.

Further, the driving device of the present invention for driving the display device and the method of the present invention for driving the display device are arranged so that: an image is displayed by turning on/off the pixel constituting the display portion in displaying the image in the display portion in the partial-screen display mode.

Further, the driving device of the present invention for driving the display device and the method of the present invention for driving the display device are arranged so that: an image is displayed by turning on/off primary colors, red (R), green (G), blue (G), in the pixel constituting the display portion.

According to the foregoing invention, an image is displayed by turning on/off the pixel constituting the display portion in displaying the image in the display portion in the partial-screen display mode. Specifically, an image is displayed by turning on/off primary colors, red (R), green (G), blue (G), in the pixel constituting the display portion. That is, generally, there are three primary colors, red (R), green (G), blue (B), in each pixel, and red (R), green (G), blue (B) are respectively turned on/off, thereby displaying eight colors different from each other. Thus, an image displayed in a waiting state is a static image, so that this image can be sufficiently recognized even when the image is displayed with eight colors different from each other, and uneven display hardly occurs even when the frequency is raised. As a result, such color display is suitable for displaying an image in the display portion in the partial-screen display mode. Note that, the colors are not necessarily limited to red (R), green (G), blue (B), but it is possible to display an image by turning on/off other colors in each pixel constituting the display portion.

Further, the driving device of the present invention for driving the display device and the method of the present invention for driving the display device are arranged so that: the control means causes a frequency of a gate clock signal of the scanning signal of the display portion in the partial-screen display mode to be higher than a frequency of a gate clock signal of the scanning signal in the full-screen display mode.

According to the foregoing invention, a frequency of a gate clock signal of the scanning signal of the display portion in the partial-screen display mode is made higher than a frequency of a gate clock signal of the scanning signal in the full-screen display mode, so that an operation speed of the display portion in the partial-screen display mode becomes higher. Thus, a display time in the display portion becomes shorter, so that it is possible to reduce power consumption caused by an invalid current also in the scanning signal line driving circuit.

Further, the driving device of the present invention for driving the display device and the method of the present invention for driving the display device are arranged so that: the control means causes a frequency of a gate clock signal of the scanning signal of the nondisplay portion in the partial-screen display mode to be smaller than a frequency of a gate clock signal of the scanning signal in the full-screen display mode.

That is, the nondisplay portion in the partial-screen display mode performs display such as white display, black display, or solid image display, and the like. In this case, the liquid crystal display device retains display for a certain time, so that an image is displayed again before the image vanishes.

Thus, in the present invention, the control means causes a frequency of a gate clock signal of the scanning signal of the nondisplay portion in the partial-screen display mode to be lower than a frequency of a gate clock signal of the scanning signal in the full-screen display mode.

On this account, an image is intermittently displayed in the nondisplay portion in the partial-screen display mode, thereby reducing the power consumption.

Further, the driving device of the present invention for driving the display device and the method of the present invention for driving the display device are arranged so that: there is provided voltage applying means for applying a voltage by using a supply line different from a supply line of the image display data signal in case of displaying an image in a nondisplay portion in the partial-screen display mode.

According to the foregoing invention, the voltage applying means applies a voltage by using a supply line different from a supply line of the image display data signal in displaying an image in the nondisplay portion in the partial-screen display mode. Thus, in case of displaying an image in the nondisplay portion in the partial-screen display mode, it is possible to apply an arbitrarily set voltage. Thus, it is possible to display a so-called solid image or a single-color image in the nondisplay portion in the partial-screen display mode.

Further, in case of displaying an image in the nondisplay portion in the partial-screen display mode, the voltage applying means applies a voltage by using a supply line different from a supply line of the image display data signal, thereby preventing the current from flowing through the shift register having the level shifter. Thus, it is possible to reduce the power consumption caused by an invalid current of the level shifter.

Further, the driving device of the present invention for driving the display device and the method of the present invention for driving the display device are arranged so that: there is provided pre-charge voltage applying means for applying a pre-charge voltage in case of displaying an image by applying the image display data signal to the display portion in the partial-screen display mode.

According to the foregoing invention, the pre-charge voltage applying means applies a pre-charge voltage in displaying an image by applying the image display data signal to the display portion in the partial-screen display mode. On this account, the image display data signal is applied after applying the pre-charge voltage to the display portion in the partial-screen display mode, thereby displaying an image. Thus, it is possible to reduce an applied voltage of the image display data signal. As a result, it is possible to further reduce the power consumption.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A driving device for driving a display device provided with a display screen, having a plurality of scanning signal lines and a plurality of data signal lines crossing each other, in which an image display data signal is outputted to a pixel provided at each of crossings through each of the data signal lines in synchronism with a scanning signal outputted from each of the scanning signal lines, said driving device comprising:

a data signal line driving circuit including a shift register which has (i) multiple stages of flip-flops each of which operates in synchronism with a source clock signal and (ii) a level shifter for boosting the source clock signal whose amplitude is smaller than a driving voltage of each of the flip-flops so as to apply the driving voltage to the flip-flop, said data signal line driving circuit causing a sampling circuit to sample the image display data signal based on an output from the shift register so as to output the image display data signal to the data signal line; and control means for causing a frequency of the source clock signal in case of displaying an image to be higher than a frequency of the source clock signal in case of normal display in which multi-gradation display is performed in a full-color mode.

2. The driving device according to claim 1, wherein:

a full-screen display mode in which a whole of a display screen performs display and a partial-screen display mode in which only a part of the display screen performs display are switched over so as to drive the display device, and the control means causes a frequency of the source clock signal in case of displaying an image in a display portion in the partial-screen display mode to be higher than a frequency of the source clock signal in case of displaying an image in a display portion in the full-screen display mode.

3. The driving device according to claim 2, wherein an image is displayed by turning on/off the pixel constituting the display portion in case of displaying the image in the display portion in the partial-screen display mode.

4. The driving device according to claim 3, wherein an image is displayed by turning on/off three primary colors, red (R), green (G), blue (B), in the pixel constituting the display portion in case of displaying the image in the display portion in the partial-screen display mode.

5. The driving device according to claim 2, wherein the control means causes a frequency of a gate clock signal of the scanning signal of the display portion in the partial-screen display mode to be higher than a frequency of a gate clock signal of the scanning signal in the full-screen display mode.

6. The driving device according to claim 2, wherein the control means causes a frequency of a gate clock signal of the scanning signal of the nondisplay portion in the partial-screen display mode to be smaller than a frequency of a gate clock signal of the scanning signal in the full-screen display mode.

7. The driving device according to claim 2, comprising voltage applying means for applying a voltage by using a supply line different from a supply line of the image display data signal in case of displaying an image in a nondisplay portion in the partial-screen display mode.

8. The driving device according to claim 2, comprising pre-charge voltage applying means for applying a pre-charge voltage in case of displaying an image by applying the image display data signal to the display portion in the partial-screen display mode.

9. A display device, provided with a display screen, having a plurality of scanning signal lines and a plurality of data signal lines crossing each other, in which an image display data signal is outputted to a pixel provided at each of crossings through each of the data signal lines in synchronism with a scanning signal outputted from each of the scanning signal lines, said display device comprising a driving device which includes:

a data signal line driving circuit including a shift register which has (i) multiple stages of flip-flops each of which operates in synchronism with a source clock signal and (ii) a level shifter for boosting the source clock signal whose amplitude is smaller than a driving voltage of each of the flip-flops so as to apply the driving voltage to the flip-flop, said data signal line driving circuit causing a sampling circuit to sample the image display data signal based on an output from the shift register so as to output the image display data signal to the data signal line; and control means for causing a frequency of the source clock signal in case of displaying an image to be higher than a frequency of the source clock signal in case of normal display in which multi-gradation display is performed in a full-color mode.

10. A method for driving a display device provided with a display screen, having a plurality of scanning signal lines and a plurality of data signal lines crossing each other, in which an image display data signal is outputted to a pixel provided at each of crossings through each of the data signal lines in synchronism with a scanning signal outputted from each of the scanning signal lines, said display device having a driving device which includes:

a data signal line driving circuit including a shift register which has (i) multiple stages of flip-flops each of which operates in synchronism with a source clock signal and (ii) a level shifter for boosting the source clock signal whose amplitude is smaller than a driving voltage of each of the flip-flops so as to apply the driving voltage to the flip-flop, said data signal line driving circuit causing a sampling circuit to sample the image display data signal based on an output from the shift register so as to output the image display data signal to the data signal line, said method comprising the step of causing a frequency of the source clock signal in case of displaying an image to be higher than a frequency of the source clock signal in case of normal display in which multi-gradation display is performed in a full-color mode.

11. The method according to claim 10, wherein:

a full-screen display mode in which a whole of a display screen performs display and a partial-screen display mode in which only a part of the display screen performs display are switched over so as to drive the display device, and a frequency of the source clock signal in case of displaying an image in a display portion in the partial-screen display mode is made higher than a frequency of the source clock signal in case of displaying an image in a display portion in the full-screen display mode.

12. The method according to claim 11, wherein an image is displayed by turning on/off the pixel constituting the display portion in case of displaying the image in the display portion in the partial-screen display mode.

13. The method according to claim 12, wherein an image is displayed by turning on/off three primary colors, red (R), green (G), blue (B), in the pixel constituting the display portion in case of displaying the image in the display portion in the partial-screen display mode.

14. The method according to claim 11, wherein a frequency of a gate clock signal of the scanning signal of the display portion in the partial-screen display mode is made higher than a frequency of a gate clock signal of the scanning signal in the full-screen display mode.

15. The method according to claim 11, wherein a frequency of a gate clock signal of the scanning signal of the nondisplay portion in the partial-screen display mode is made smaller than a frequency of a gate clock signal of the scanning signal in the full-screen display mode.

16. The method according to claim 11, wherein a voltage is applied by using a supply line different from a supply line of the image display data signal in case of displaying an image in a nondisplay portion in the partial-screen display mode.

17. The method according to claim 11, wherein a precharge voltage is applied in case of displaying an image by applying the image display data signal to the display portion in the partial-screen display mode.

* * * * *